US010220247B2

(12) United States Patent
Ellis et al.

(10) Patent No.: US 10,220,247 B2
(45) Date of Patent: Mar. 5, 2019

(54) BODY WEIGHT RESISTANCE ROWING SIMULATOR EXERCISE MACHINE WITH A FORCE REDUCTION TRANSMISSION

(71) Applicant: Product Design Innovations, LLC, Ocala, FL (US)

(72) Inventors: Joseph K. Ellis, Ocala, FL (US); Joshua M. Aguilar, Gainesville, FL (US)

(73) Assignee: Product Design Innovations, LLC, Ocala, FL (US)

( * ) Notice: Subject to any disclaimer, the term of this patent is extended or adjusted under 35 U.S.C. 154(b) by 0 days.

(21) Appl. No.: 15/798,119

(22) Filed: Oct. 30, 2017

(65) Prior Publication Data

US 2018/0169463 A1 Jun. 21, 2018

Related U.S. Application Data

(60) Provisional application No. 62/517,372, filed on Jun. 9, 2017, provisional application No. 62/437,518, filed on Dec. 21, 2016.

(51) Int. Cl.
*A63B 21/00* (2006.01)
*A63B 21/22* (2006.01)
(Continued)

(52) U.S. Cl.
CPC .... *A63B 22/0076* (2013.01); *A63B 21/00069* (2013.01); *A63B 21/00181* (2013.01);
(Continued)

(58) Field of Classification Search
CPC ..... A63B 22/0076; A63B 23/03575; A63B 21/155; A63B 21/00069; A63B 23/1209;
(Continued)

(56) References Cited

U.S. PATENT DOCUMENTS 4,396,188 A 8/1983 Dreissigacker
4,743,010 A * 5/1988 Geraci ..... A63B 22/0076 482/72

(Continued)

FOREIGN PATENT DOCUMENTS

WO 2016064605 A1 4/2016

*Primary Examiner* — Garrett K Atkinson
(74) *Attorney, Agent, or Firm* — Laurence P. Colton; Smith Tempel Blaha LLC

(57) ABSTRACT

A user weight resisted rowing exercise simulation machine with a movable user support pivotally connected to a forward portion of a stationary horizontal base frame and a slidable seat and rigid feet support mounted to the movable user support frame and a pulling handle operatively connected to the movable user support frame such that moving the pulling handle towards the rearward portion of the machine causes the rearward portion of the user support frame to pivot upward and moving the pulling handle away from the rearward portion of the machine causes the rearward portion of the movable user support to pivot downward and the force required to move the pulling handle towards the rearward portion of the machine is reduced and controlled by the operative connection of the pulling handle to the user support frame.

34 Claims, 22 Drawing Sheets

(51) Int. Cl.

| | |
|---|---|
| ***A63B 22/00*** | (2006.01) |
| ***A63B 23/04*** | (2006.01) |
| ***A63B 23/12*** | (2006.01) |
| ***A63B 21/068*** | (2006.01) |
| ***A63B 23/035*** | (2006.01) |

(52) U.S. Cl.
CPC ..... *A63B 21/068* (2013.01); *A63B 21/155* (2013.01); *A63B 21/22* (2013.01); *A63B 21/4035* (2015.10); *A63B 22/0046* (2013.01); *A63B 23/03575* (2013.01); *A63B 23/0405* (2013.01); *A63B 23/1209* (2013.01); *A63B 2022/0079* (2013.01); *A63B 2208/0228* (2013.01)

(58) Field of Classification Search
CPC ..... A63B 23/0405; A63B 21/068; A63B 21/00181; A63B 22/0046; A63B 21/22; A63B 21/4035; A63B 2022/0079; A63B 2208/0228
See application file for complete search history.

(56) References Cited

U.S. PATENT DOCUMENTS 5,072,929 A 12/1991 Peterson
5,201,694 A * 4/1993 Zappel ..... A63B 21/00072 482/133
5,569,130 A * 10/1996 Wang ..... A63B 22/0076 482/51
7,537,554 B2 * 5/2009 Zhuang ..... A63B 21/023 482/121
7,572,211 B2 8/2009 Roach
7,803,095 B1 * 9/2010 LaGree ..... A63B 22/0089 482/121
7,967,728 B2 * 6/2011 Zavadsky ..... A63B 21/00 434/247
8,287,434 B2 * 10/2012 Zavadsky ..... A63B 21/00 482/1
8,303,470 B2 * 11/2012 Stewart ..... A63B 22/001 482/52
8,641,585 B2 * 2/2014 LaGree ..... A63B 21/023 482/92
8,852,062 B2 * 10/2014 Dorsay ..... A63B 23/1209 482/121
9,011,291 B2 * 4/2015 Birrell ..... A63B 71/0622 482/4
9,199,123 B2 * 12/2015 Solow ..... A63B 26/00
2001/0027150 A1 * 10/2001 Duke ..... A63B 21/154 482/72
2002/0137607 A1 * 9/2002 Endelman ..... A63B 21/023 482/123
2006/0183606 A1 * 8/2006 Parmater ..... A63B 22/0076 482/72
2007/0202992 A1 * 8/2007 Grasshoff ..... A63B 21/0058 482/8
2007/0270293 A1 * 11/2007 Zhuang ..... A63B 21/023 482/123
2008/0242519 A1 * 10/2008 Parmater ..... A63B 22/0076 482/72
2010/0125026 A1 * 5/2010 Zavadsky ..... A63B 21/00 482/5
2010/0267524 A1 * 10/2010 Stewart ..... A63B 22/001 482/52
2011/0009249 A1 * 1/2011 Campanaro ..... A63B 21/068 482/131
2011/0152045 A1 * 6/2011 Horne ..... A63B 24/0062 482/131
2012/0100965 A1 * 4/2012 Dreissigacker .... A63B 21/0088 482/72
2012/0202656 A1 * 8/2012 Dorsay ..... A63B 21/156 482/121
2012/0295771 A1 * 11/2012 LaGree ..... A63B 21/023 482/94
2013/0196835 A1 * 8/2013 Solow ..... A63B 26/00 482/142
2013/0210578 A1 * 8/2013 Birrell ..... A63B 71/0622 482/4
2014/0121076 A1 * 5/2014 Lagree ..... A63B 21/0552 482/123
2014/0194260 A1 * 7/2014 Campanaro ..... A63B 21/068 482/131
2014/0243136 A1 8/2014 Edmondson
2016/0144223 A1 * 5/2016 Dalebout ..... A63B 22/0076 482/72
2018/0117393 A1 * 5/2018 Ercanbrack ..... A63B 22/0046
2018/0126216 A1 * 5/2018 Hamilton ..... A63B 22/0076

* cited by examiner

BODY WEIGHT RESISTANCE ROWING SIMULATOR EXERCISE MACHINE WITH A FORCE REDUCTION TRANSMISSION

STATEMENT OF RELATED APPLICATIONS

This application claims priority on and the benefit of U.S. Provisional Patent Application No. 62/437,518 having a filing date of 21 Dec. 2016 and U.S. Provisional Patent Application No. 62/517,372 having a filing date of 9 Jun. 2017.

BACKGROUND OF THE INVENTION

Technical Field

This invention relates to the general technical field of exercise, physical fitness and physical therapy equipment and machines. This invention relates more specifically to the field of cardiovascular and strength conditioning rowing exercise simulator machines wherein the weight of the user plus a movable user support provides the resistance to the exercise motion and does not require a separate resistance source.

Prior Art

Exercise, physical fitness and physical therapy equipment and machines are available in various configurations and for various purposes, and are available for all of the major muscle groups. Most of these machines and equipment, especially in the exercise field, require a separate resistance mechanism to impart force upon the user to the exercise motion provided by the machine. Most rowing simulator exercise machines require a force transfer component such as a belt or cable operatively connected to a force resisting mechanical assembly such as a fan, inertia disc with a braking component, an enclosed liquid container that resist rotating paddles or a combination of force resisting mechanical assemblies. These force resisting mechanical assemblies add additional cost to producing these products, they require additional maintenance and increase the amount of wear components.

This inventor has previously developed exercise machines that simultaneously combine upper and lower body motions. However, the current invention is another type of exercise motion that concurrently engages a user's upper and lower body that fills a need not previously met.

Most prior art rowing exercise machines have generally been developed to simulate rowing a boat in the water which requires a one directional concentric motion resistance only that has to be provided by a mechanical assembly to impart force against the pulling handle. Other prior art rowing machines provide variations of at least partial body weight resistance but have deficiencies when compared to the unique function of the present invention.

U.S. Pat. No. 5,072,929 of Peterson teaches a rowing machine with a separate flywheel resistance mechanism for the pulling handle and a separate flywheel resistance mechanism for the slidable user seat. While this may be a useful feature for certain users both of these flywheels require constant motion to impart force upon the pulling handle or seat. Furthermore, these additional resistance components increase the manufacturing cost and the amount of wear items in the machine. This machine also keeps the angular orientation of the user seat constant relative to the floor throughout the range of motion which makes it more challenging to achieve the correct torso angle at the fully extended range of motion. The present invention overcomes both of these deficiencies first by eliminating the need for an additional resistant producing mechanism and secondly by positioning the user at the correct biomechanical torso angle at the starting position of the exercise wherein the user seat is parallel to the floor and positioning the user at the correct biomechanical torso angle at the fully extended position of the exercise wherein the user seat is angled upward from front to back and the user's hips have increased in elevation relative to the user's feet.

U.S. Pat. No. 7,572,211 of Roach teaches a rowing simulator machine comprising a user seat that is slidably engaged with a stationary base support frame and a footrest and force resistance mechanism also slidably engaged with said stationary base support frame. Said user seat and foot rest and force resistance mechanism are slidably engaged with said stationary base frame such that the user seat and footrest and force resistance mechanism can slide horizontally in a forward or rearward direction during the exercise motion. This inertia flywheel resistance mechanism requires constant motion to impart force upon the pulling handle. Furthermore, this additional resistance component increases the manufacturing cost and the amount of wear items in the machine. This machine also keeps the angular orientation of the user seat constant relative to the floor throughout the range of motion which makes it more challenging to achieve the correct torso angle at the fully extended range of motion. The present invention overcomes both of these deficiencies first by eliminating the need for an additional resistant producing mechanism and secondly by positioning the user at the correct biomechanical torso angle at the starting position of the exercise wherein the user seat is parallel to the floor and positioning the user at the correct biomechanical torso angle at the fully extended position of the exercise wherein the user seat is angled upward from front to back and the user's hips have increased in elevation relative to the user's feet.

U.S. Pat. No. 4,396,188 of Dreissigacker teaches a rowing simulator machine comprising a user support seat slidably mounted on a stationary horizontal base frame and a pulling handle operatively connected to force resisting mechanical flywheel assembly and a feet engagement surface mounted on the stationary main frame such that engagement of the pulling handle by the user generates a resistance force of the flywheel during the exercise motion. This inertia flywheel resistance mechanism requires constant motion to impart force upon the pulling handle. Furthermore, this additional resistance component increases the manufacturing cost and the amount of wear items in the machine. This machine also keeps the angular orientation of the user seat constant relative to the floor throughout the range of motion which makes it more challenging to achieve the correct torso angle at the fully extended range of motion. The present invention overcomes both of these deficiencies first by eliminating the need for an additional resistant producing mechanism and secondly by positioning the user at the correct biomechanical torso angle at the starting position of the exercise wherein the user seat is parallel to the floor and positioning the user at the correct biomechanical torso angle at the fully extended position of the exercise wherein the user seat is angled upward from front to back and the user's hips have increased in elevation relative to the user's feet.

US Patent Publication No. 20140243136 of Edmondson teaches a rowing simulator exercise machine comprising a base having a raised front end and a lower rear end: a user supporting seat slidable on the base and footrest for receiving a user's feet on the base; a rotational inertia device for providing resistant to the user during use rotatable about a first shaft; a handle for grasping by the user connected on an end of a cable, which engages the first shaft for rotating the rotational inertia device upon application of a rearwardly directed force by the user, the handle and the cable being moveable between a retracted rest position and an extended use position upon application of the force by the user, thereby simulating rowing. This machine is similar to most prior art rower exercise machines which simulate rowing a boat in the water in that it requires a mechanical rotational inertia flywheel with a uni-directional clutch in the hub of the flywheel to providing resistance to the exercise motion, however most of these prior art rowers utilize a spring or elastic cable to return the pulling handle to the starting position from the end of the rowing stroke because the uni-directional clutch flywheel imparts one directional force only during the concentric motion when the pulling handle is being pulled and does not apply any return force to bring the pulling handle back to the start position. The Edmondson '326 machine is designed to eliminate the spring or elastic cable component that returns the pulling handle to the start position and replace it with a gravity fed return force but said gravity fed force is not adequate or intended to provide the amount of resistance required for the concentric pulling motion of the exercise. As with other flywheel resisted devices, Edmondson '326 teaches foot straps that allow the user's legs to assist with the return force of the pulling chain further emphasizing that the return force of the pulling chain is not designed to provide significant concentric or eccentric resistance to the exercise movement. Edmondson '326 also teaches an optimal handle return force of a constant 7 pounds that is designed to take up the slack of the handle pull chain during the return motion of the exercise but would not provide adequate resistance to even the most deconditioned user during the pulling motion of the exercise. This constant 7 pounds of handle return force is achievable even with various weight users whereby the movable user support stays in constant slidable contact with a supporting base frame so that only a very small percentage of the user support and the user's body weight affect the return force to the pulling handle. The flywheel resistance mechanism required by Edmondson '326 adds to the cost of producing the machine and creates additional wear items when compared to the current invention. Although the angle of the user seat of Edmondson '326 does vary slightly from the start position to the fully extended position it slopes downward from front to back thereby lowering the user's hips relative to the user's feet in the fully extended position and places the user's torso relative to the user's hips in what many users would consider a more challenging position to complete the exercise motion. The present invention overcomes the deficiencies of the Edmonson '326 machine first by eliminating the need for an additional resistant producing mechanism which saves manufacturing cost and reduces wear items. Resistance in addition to the user's weight and the weight of the user support is not required for the present invention because the drive cable lifts the user and user support away from contacting the support base except for the forward pivot so that most of the weight of the user and user support is supported by the drive cable which imparts force to the pulling handle creating a substantial amount of variable resistance to the exercise motion in both the concentric and eccentric portions of the exercise and said resistance to the pulling handle is reduced by the force reduction transmission so the machine can be operated by users or ordinary ability. This amount of weight resistance also eliminates the need for foot straps to assist with moving the handle back to the start position further reducing cost and wear items. In overcoming another deficiency of other rowing machines, the current invention positions the user at the correct biomechanical hip and torso angle at the starting position of the exercise wherein the user seat is parallel to the floor and positioning the user at the correct biomechanical hip and torso angle at the fully extended position of the exercise wherein the user seat is angled upward from front to back and the user's hips have increased in elevation relative to the user's feet thereby placing the user's torso in a better position relative to the user's hip to complete the rowing exercise motion.

WO International Application No. 2016/064605 of Campanaro teaches a rowing simulation machine comprising a support structure; a movable user support movably associated with the support structure for movement relative to the support structure; a movable foot support movably associated with the support structure for movement relative to the support structure; a handle; and a rowing assembly operatively associated with the handle and at least the movable foot support to cause at least the movable foot support to move relative to the support structure with movement of the handle so that so that both a user's body and one or both feet move relative to the support structure with movement of the handle. Campanaro '605 uses body weight for a portion of the resistance component such that the user support, the mechanical rowing assembly and the foot support all move in a fixed upward slope from the at rest position to the fully extended position. However, the mechanism also requires at least one resistance device such as a spring to be connected at a first end to the stationary base and connected at a second end to the movable foot support. The fixed slope of Campanaro '605 keeps the user's hips elevated relative to the user's feet throughout the entire range of motion and many users would prefer to increase the elevation of the user's hips relative to the user's feet from the starting position to the fully extended position as they go through the range of motion as is provided in the current invention. The sliding foot support on Campanaro 605 also creates additional wear components as opposed to the foot support of the present invention which is rigidly attached to the user support frame.

BRIEF SUMMARY OF THE INVENTION

The present invention was developed to provide an improved strength and cardiovascular conditioning rowing simulator exercise machine comprising a slidable user seat and a fixed foot support each mounted on an elongated movable user support frame assembly, and said user support frame is pivotally mounted at a forward end to a forward portion of an elongated horizontal stationary base frame and said user support frame is mostly supported by and movable by a pulleys and cable assembly, said cable assembly has a first end and a second end and is connected at a first end to a central or rearward portion of said user support frame and connected at a second end to a force reduction transmission assembly, said transmission assembly being rotatably mounted on the stationary horizontal base frame. A drive belt with a first and second end is connected at a first end to a pulling handle and connected at a second end to said force reduction transmission assembly such that movement of the pulling handle causes the force reducing transmission assembly to rotate and the user support cable and pulley assembly to lift the pivotable user support frame away from the base frame or lower the pivotable user support frame towards the base frame while the user slides backwards or forwards on said user support frame during operation of the machine to simulate a body weight resistance rowing exercise motion.

The invention can also be configured with telemetry components for providing a user with information pertaining to their workout duration and performance such as elapsed time, stroke count, resistance pulled, heart rate and other useful information.

In a preferred embodiment of the invention the user support frame pivots away from or towards the base frame in an upward and downward arcing motion when pulled or released by the user support drive cable as the force of the transmission assembly and the first drive belt and pulling handle is increased or decreased by a user. Movement of the user support drive cable will pivot the user support frame about a pivot located on a forward portion of the machine causing the rearward portion of the user support frame to pivot upward away from the base frame or downward towards the base frame during operation of the machine. The rearward most portion of the user support frame is at the lowest elevation relative to the base frame in the at rest an inactivated position and the rearward most portion of the user support frame is at the highest elevation relative to the base frame in the engaged and fully activated position and can be maintained at any position between the at rest and inactivated position and the engaged and fully activated position during operation of the machine.

The force reduction transmission assembly can be configured with one or more axles and two or more take up drums or pulleys and said take up drums or pulleys can be adjustable in diameter such that the force reduction of the transmission assembly can be adjusted.

In certain alternative embodiments one or more pivoting levers can be combined with the lifting cable and pulleys assembly to lift and lower the user support and the connection of the lifting cable to one of the levers can be adjustable for making the force required by the user to lift and lower the user support adjustable.

The present invention provides features and advantages not previously available in prior art rowing simulator exercise machines. Those features and advantages include a forward pivoting user support frame that houses a sliding user seat whereas the angle of the user seat changes as it slides on the pivoting user support causing the angle of the user's torso to vary relative to the floor and the elevation of the user's hips relative to the user's feet to vary during operation of the machine, said forward pivoting user support frame and the user's body weight also provide the resistance to the exercise motion eliminating the need for an additional resistance producing mechanism. By eliminating the need for a separate resistance mechanism, the present invention creates a more cost effective machine to manufacture and maintain. The present invention provides a substantial amount of concentric and eccentric resistance to the rowing exercise motion so as to improve the user's strength and cardiovascular conditioning. The present invention also provides a lifting or lowering while sliding exercise motion that is compelling and fun to use so as to motivate the user to increase their frequency and duration of use as a part of reaching his or her health and fitness goals.

These features, and other features and advantages of the present invention, will become more apparent to those of ordinary skill in the art when the following detailed description of the preferred embodiments is read in conjunction with the appended figures in which like reference numerals designate like elements throughout the several views.

BRIEF DESCRIPTION OF THE DRAWINGS

The figures illustrate each embodiment from multiple angle views to best illustrate the features and functions of each embodiment. Some of the figures illustrate a user mounted on the machine for clarity of the exercise motion. Some of the figures illustrate an individual component or assembly to clearly illustrate the individual parts required to produce those components or assemblies.

DETAILED DESCRIPTION OF PREFERRED EMBODIMENTS

Figure 1:
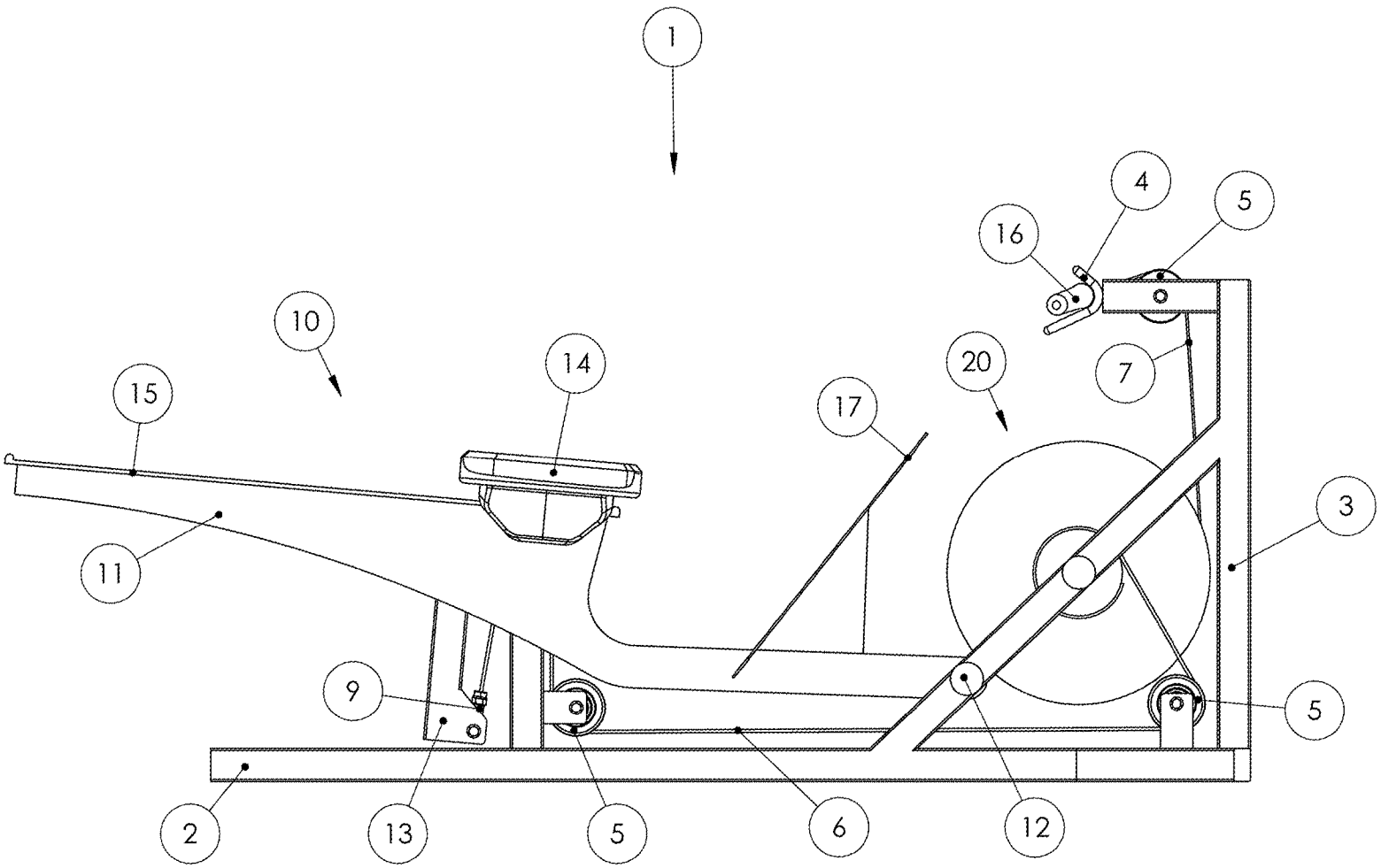
FIG. 1 is a side view of the invention with a single axle force reduction transmission in the at rest and inactivated position.
Figure 2:
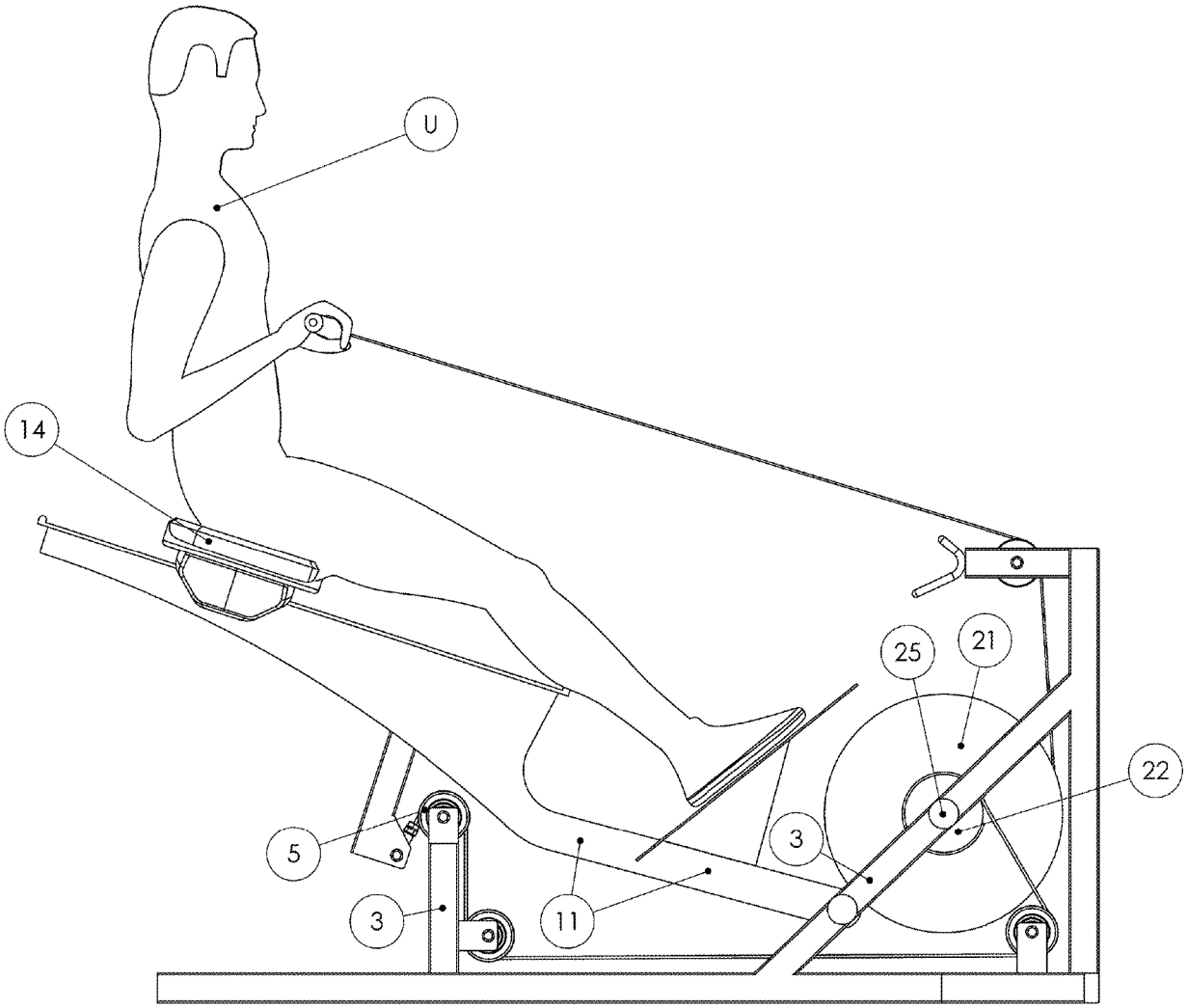
FIG. 2 is a side view of the invention with a single axle force reduction transmission and a user mounted on the machine in the engaged and activated position.
Figure 3:
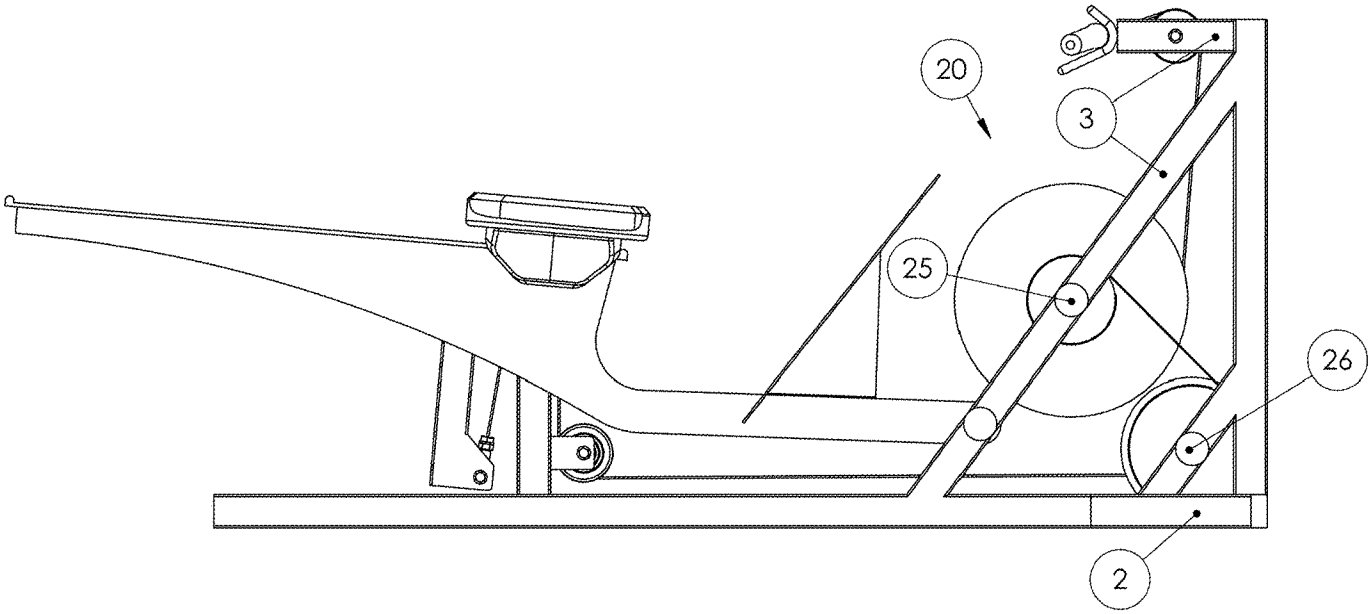
FIG. 3 is a side view of the invention with a two axle force reduction transmission in the at rest and inactivated position.
Figure 4:
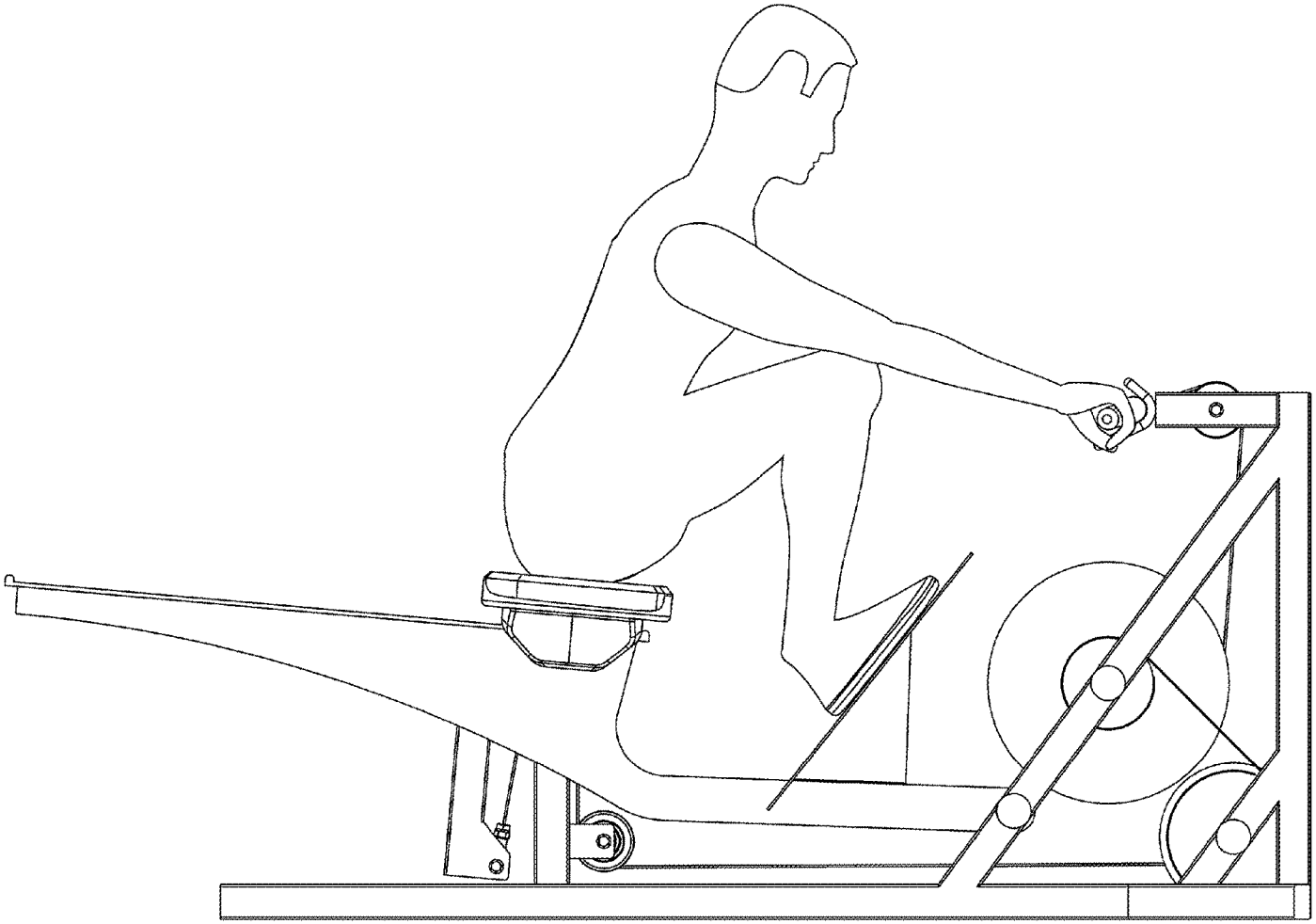
FIG. 4 is a side view of the invention with a two axle force reduction transmission and a user mounted on the machine in the at rest and inactivated position.
Figure 5:
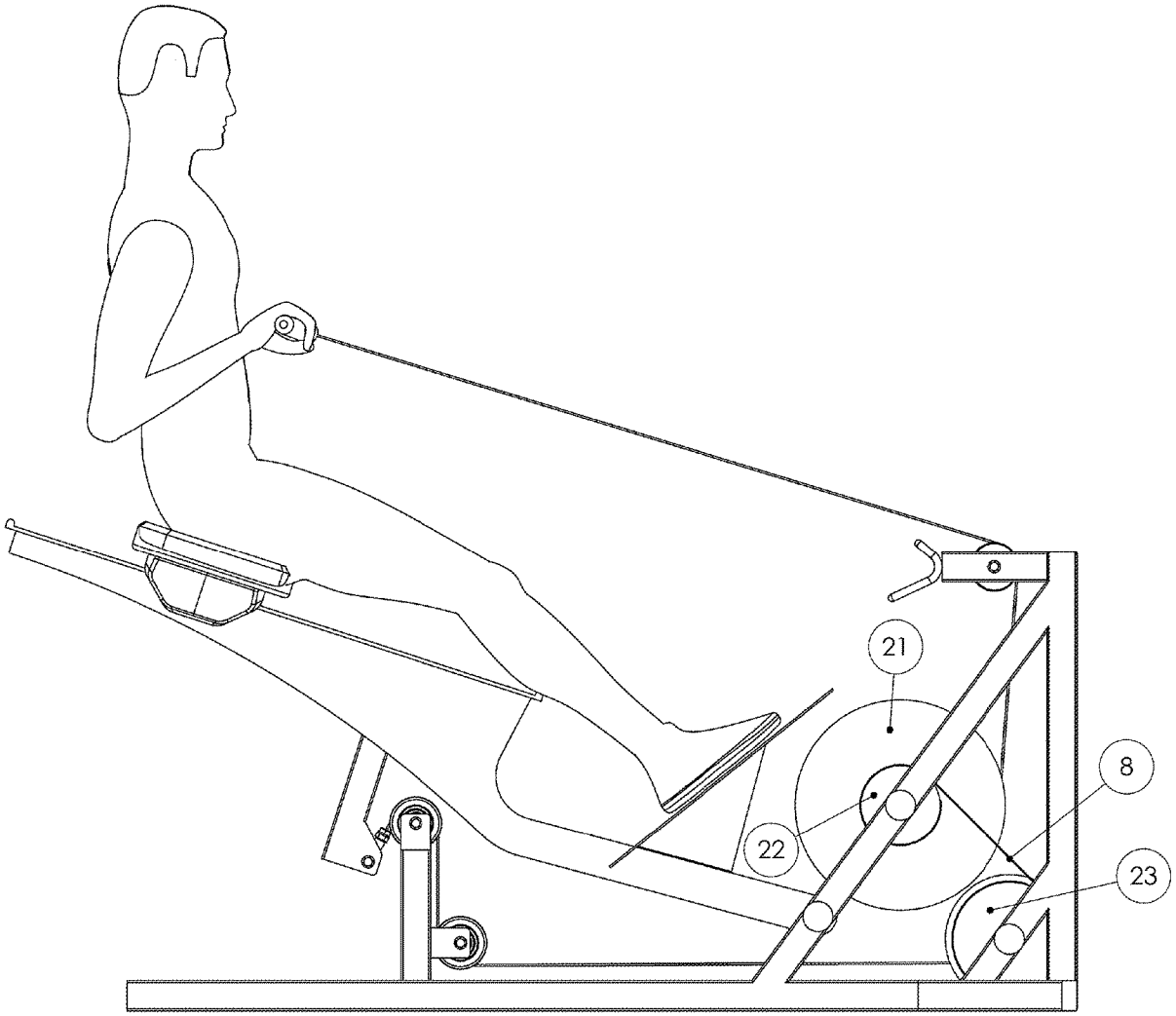
FIG. 5 is a side view of the invention with a two axle force reduction transmission and a user mounted on the machine in the engaged and activated position.
Figure 6:
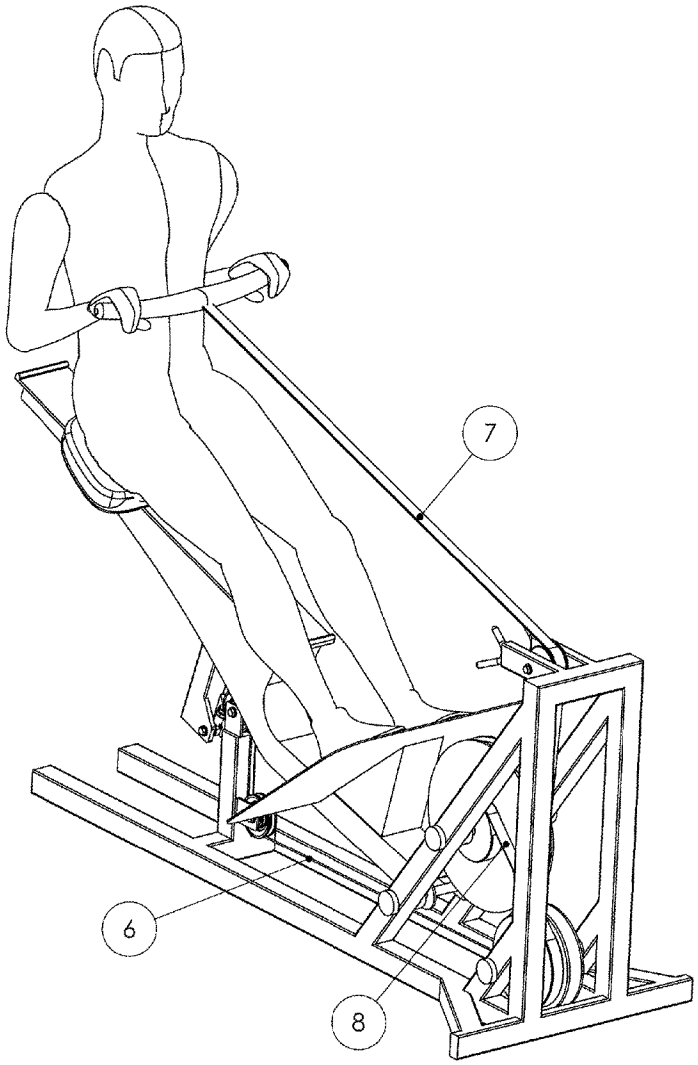
FIG. 6 is a perspective view of the invention with a two axle force reduction transmission and a user mounted on the machine in the engaged and activated position.

Exemplary preferred embodiments are disclosed below in connection with the attached drawings. Throughout this specification and disclosure, various terms will be used to describe various elements or sets of elements, features or sets of features, and devices or sets of devices. For example, the term forward end or portion of the machine would refer to the end or portion of the machine most proximal to the pivotally connected end of the moveable user support frame assembly. The term rearward end or portion of the machine would refer to the end or portion of the machine most distal to the pivotally connected end of the moveable user support frame assembly. The term user support frame assembly or movable user support frame assembly will be used to describe the rigid pivoting frame that the seat rolls upon combined feet support surface. The term base frame will be used to describe the stationary horizontal rigid portion of the frame that contacts the floor combined with angular and vertical stationary rigid portions of the frame that support various functional components of the machine such as pulleys and axles. The terms transmission, rotational force reduction transmission assembly, or adjustable rotational force reduction transmission assembly will refer to the mechanical device mounted proximal to the forward base portion of the machine that includes a rotatable axle or in some embodiments multiple rotatable axles combined with multiple take up drums and or pulleys and or gears and or flexible members. The terms at rest, inactivated, and starting positions will be used to describe when the user is not engaging the machine, or only minimally so. The terms activated, extended, engaged, and operating will be used to describe when the user is in motion performing an exercise on the machine. The term engaged and fully activated is use to describe when a user has moved the pulling handle a maximum distance from the at rest position with the understanding that the size of the user will determine how far he or she is capable of moving the pulling handle. The term releasing or releases will be used to describe the user's action during operation of the machine when the user is reducing or lessening their exertion force upon the pulling handle. The term upper body will refer generally to the user's arms, hands, and torso. The term lower body will generally refer to the user's legs and feet but may also refer to the user's buttocks and hips as well. The term flexible member will refer to any component constructed as a rope, cable, chain, belt, or the like. The term slidable will be used to describe a component that slides or rolls in a linear pattern. The term adjustable will refer to a component or assembly on the machine that can be adjusted to various setting prior to operation of the machine.

FIGS. 1-22 are all views of preferred or alternative embodiments or components or of the invention this inventor terms "a body weight resistance rowing simulator exercise machine with a force reduction transmission." Generally, the invention is a rowing exercise simulating machine wherein the user moves in an upward and downward arcing motion while simultaneously sliding back and forth on a free moving seat while pulling and releasing a handle operatively engaged with a force reducing transmission assembly that reduces the force required by the user to lift themself and the user support during the exercise motion. The invention comprises a force reduction transmission assembly with at least one axle and at least two take up drums rotatable on said axle. The invention also comprises a pulling handle, at least two flexible members, and multiple guide pulleys for transferring the exertion force of the user and the lifting force of the transmission assembly. The invention may also be configured with an adjustable force reduction transmission assembly such that the force required by the user to lift themself and the user support can be increased or decreased. In an alternative embodiment of the invention a portion of the user support can be supported and lifted by two pivoting lever support bars connecting the stationary base to the movable user support frame.

FIGS. 1-22 provide various views of the preferred embodiments and components and alternative embodiments and components of machine 1 to provide a more complete understanding of the invention. In all embodiments of the invention machine 1 comprises movable user support frame assembly 10, stationary base frame 2, base frame upper support structure 3, rotatable force reduction transmission assembly 20, first flexible member 6 and second flexible member 7, and pulling handle 16. Pulling handle 16 and second flexible member 7 are operatively linked by rotatable force reduction transmission assembly 20 to first flexible member 6 and user support frame assembly 10. Machine 1 can be constructed of any suitable material, such as formed tubes, bars, or channels, made from steel, aluminum, or other metals or other suitable materials for supporting the working components of machine 1 and user U.

In all preferred embodiments of the invention, base frame 2 is an elongated horizontal structure that contacts the floor and is structurally sufficient to support machine 1 and user U during operation of machine 1. Base frame 2 is long enough and wide enough to prevent the machine 1 from becoming unstable during the exercise motion and is represented in the illustrated figures as being wider at the front portion of the machine 1 adjacent to force reduction transmission assembly 20. The base frame 2 is also rigidly connected to base frame upper support structure 3 which can be configured in various forms but is represented as a series of stationary vertical, angular, and horizontal tubes that connect to and support various components of machine 1.

In preferred embodiments of the invention, the user support frame assembly 10 is connected to base frame upper support structure 3 at user support frame pivot 12 and is supported on a central portion of user support frame 11 by the connection of first flexible member 6 with flexible cable anchor 9 which is connected to user support frame cable attachment bracket 13. Seat slide rail 15 is rigidly mounted on user support frame 11 and user seat 14 is rollably or slidably engaged with seat slide rail 15 such that user U can freely move forward and backwards on seat slide rail 15 during operation of machine 1. User feet support 17 is rigidly connected to user support frame 11 such that user U can place his or her feet on user feet support 17 and push away from user feet support 17 during the pulling motion of the exercise and brace against user feet support 17 during the holding or releasing motion of the exercise. User support frame 11 can be made of any structural configuration capable of supporting user U and the other components of user support frame assembly 10 during operation of machine 1, however in the illustrated figures, user support frame 11 is represented as a formed metal channel and user support frame cable attachment bracket 13 is rigidly connected to a central portion of user support frame 11 between the two formed sides of said channel and slide support surface 15 and user feet support 17 are rigidly mounted to the top cross section of the formed channel.

In preferred embodiments of the invention, the rotatable force reduction transmission assembly 20 reduces and controls the amount of pulling force required by user U to pulling handle 16 to lift and pivot user support frame assembly 10 and user U and rotatable force reduction transmission assembly 20 can be constructed in multiple embodiment configurations. In illustrated embodiments of machine 1, rotatable force reduction transmission assembly 20 is represented as being mounted on the forward portion of base frame 2 and specifically base frame upper support structure 3; however, it could be mounted to a rearward portion of base frame 2 and achieve the same function of machine 1.

Figure 12:
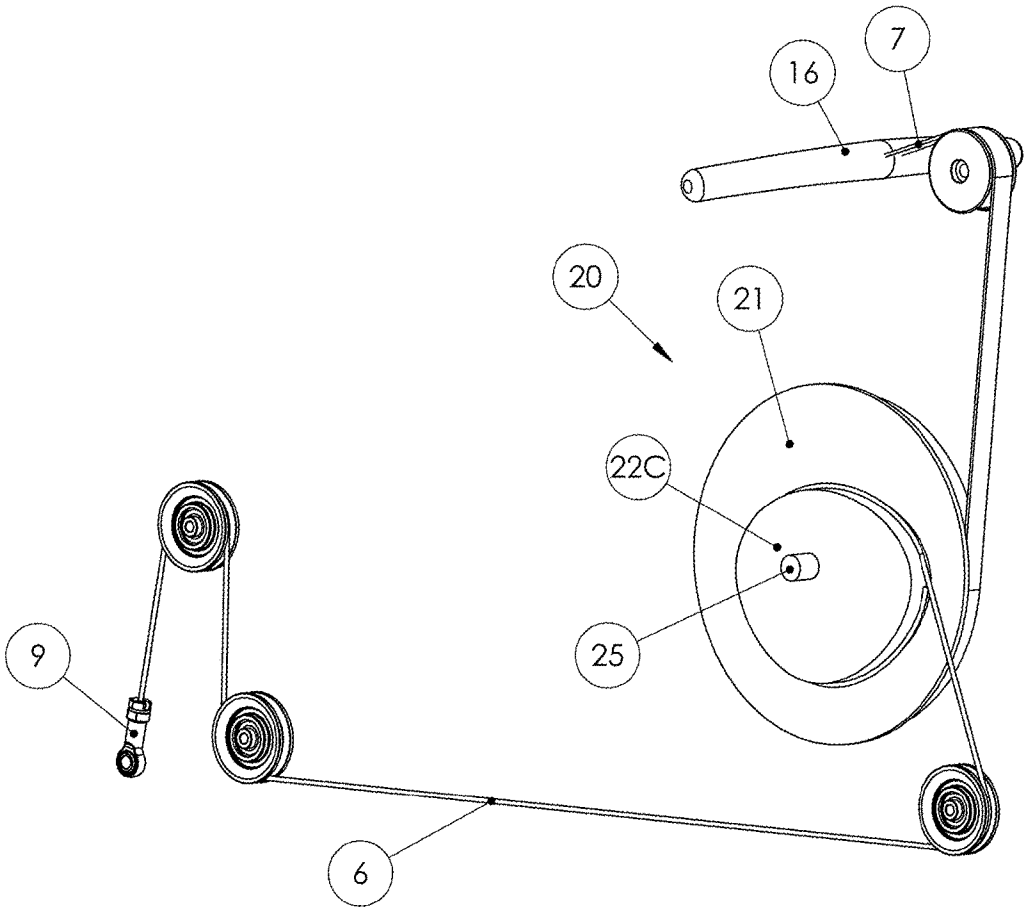
FIG. 12 is an isolated perspective view of the drive system with a single axle version of the force reduction transmission assembly of the invention with variable force reduction.
Figure 13:
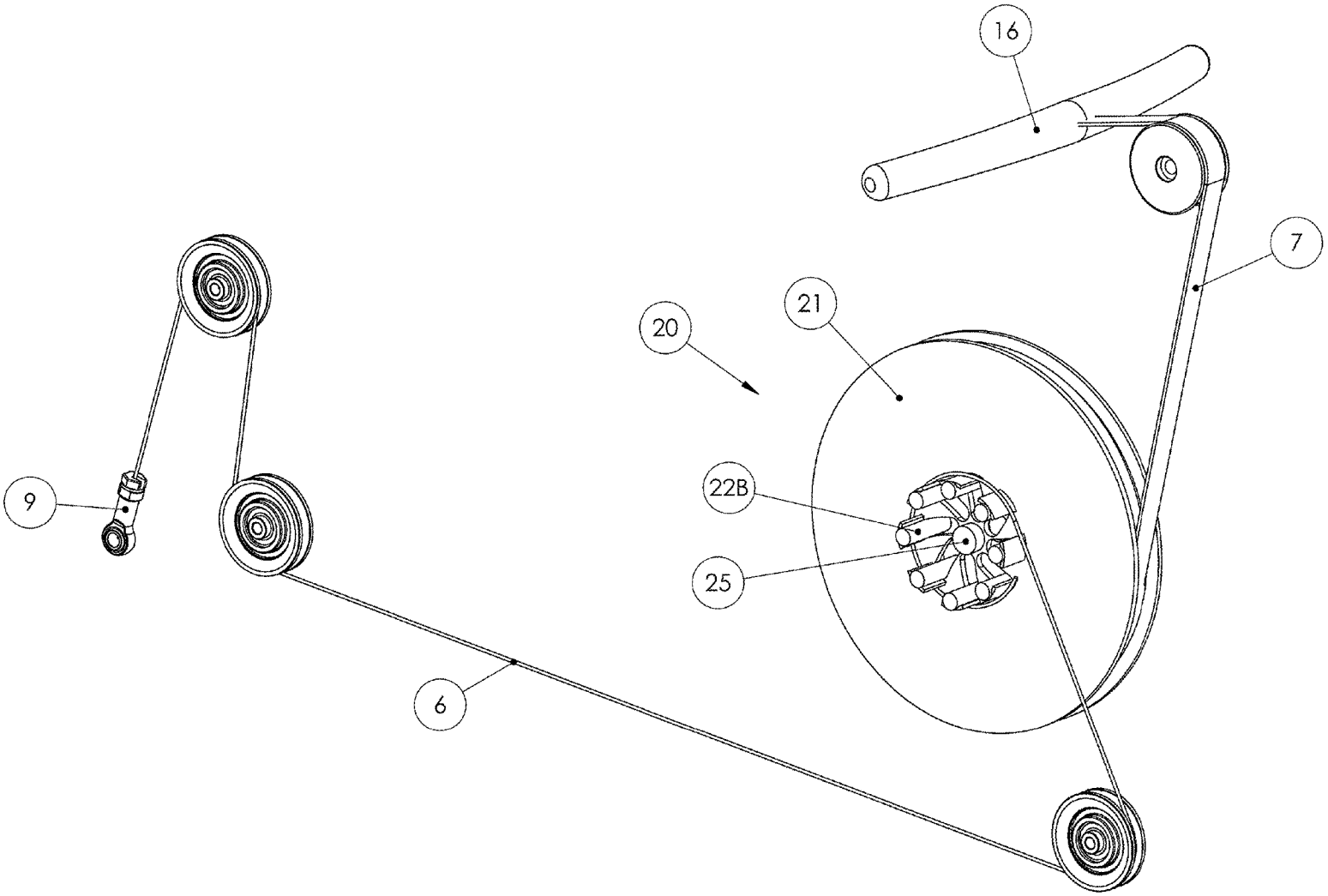
FIG. 13 is an isolated perspective view of the drive system with a single axle version of the force reduction transmission with adjustable force reduction wherein the force reduction is at a decreased setting.
Figure 14:
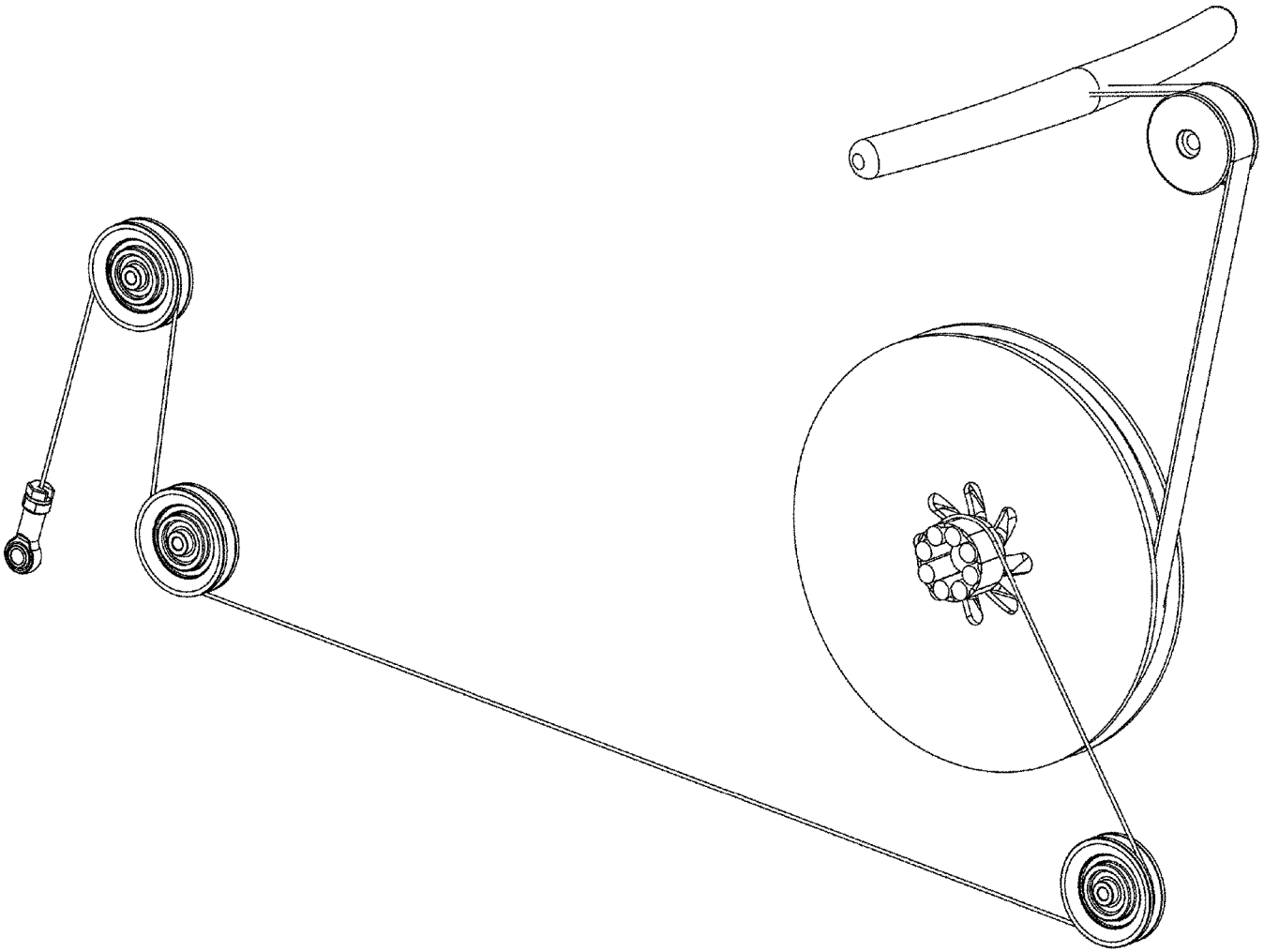
FIG. 14 is an isolated perspective view of the drive system with a single axle version of the force reduction transmission with adjustable force reduction wherein the force reduction is at an increased setting.

Preferred embodiments of transmission assembly 20 can achieve a similar function; however, each of the various represented configurations have unique characteristics with regard to controlling the amount of force required to rotate transmission assembly 20 throughout the range of motion, the number of components, the alignment of certain components relative to each other, the size of the components and the complete assembly, durability for intended use and cost to produce. For example, in a first configuration, as illustrated in FIGS. 1, 2, 12, 13, 14, and 19-22, transmission assembly 20 is comprised of a first axle 25, first take up drum 21 and second take up drum 22. This configuration requires the fewest components but the diameter of first take up drum 21 will be much larger than in other configurations to produce the same amount of force reduction as the other represented configurations. In this configuration first take up drum 21 and second take up drum 22 can be circular such that the reduction of force produced by the transmission assembly 20 is constant throughout the range of motion such as illustrated in FIGS. 1, 2, 13, 14, and 19-21. Also in this configuration, the diameter of second take up 22 can be adjustable as with adjustable second take up drum 22B as illustrated in FIGS. 13 and 14 such that the force required by user U to lift user support assembly 10 and user U can be increased or decreased. Also in this configuration, second take up 22 can be cam shaped as with cam shaped second take up drum 22C as illustrated in FIG. 12 such that the reduction of force produced by transmission assembly 20 is variable throughout the range of motion.

Figure 7:
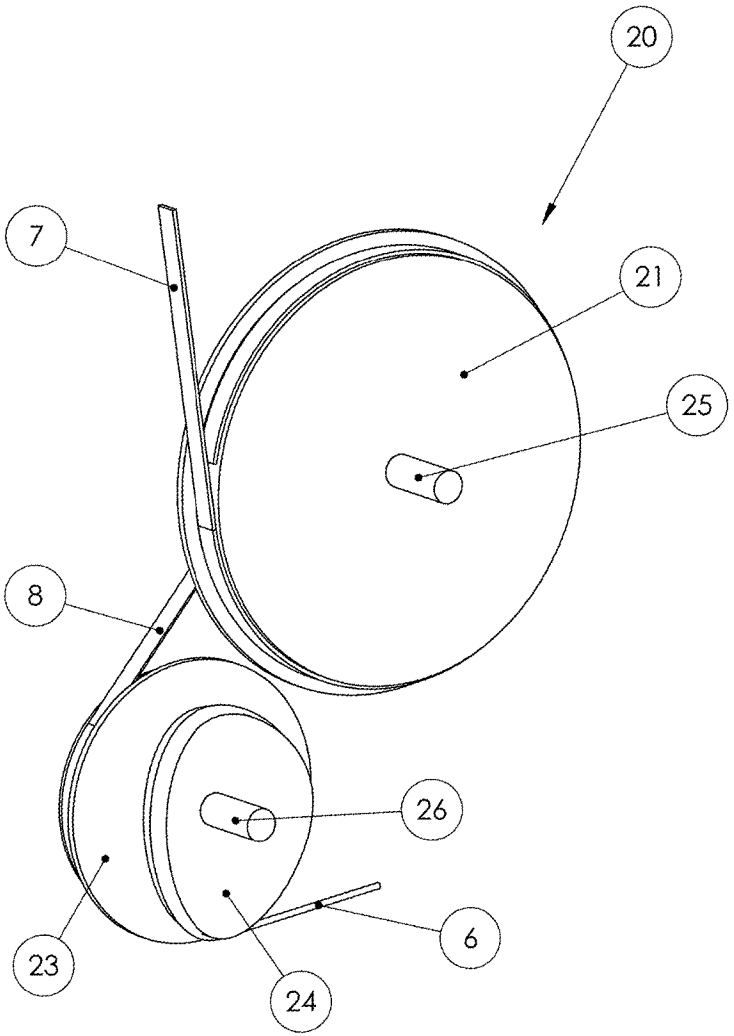
FIG. 7 is an isolated perspective view of a two axle version of the force reduction transmission assembly with variable force reduction.
Figure 8:
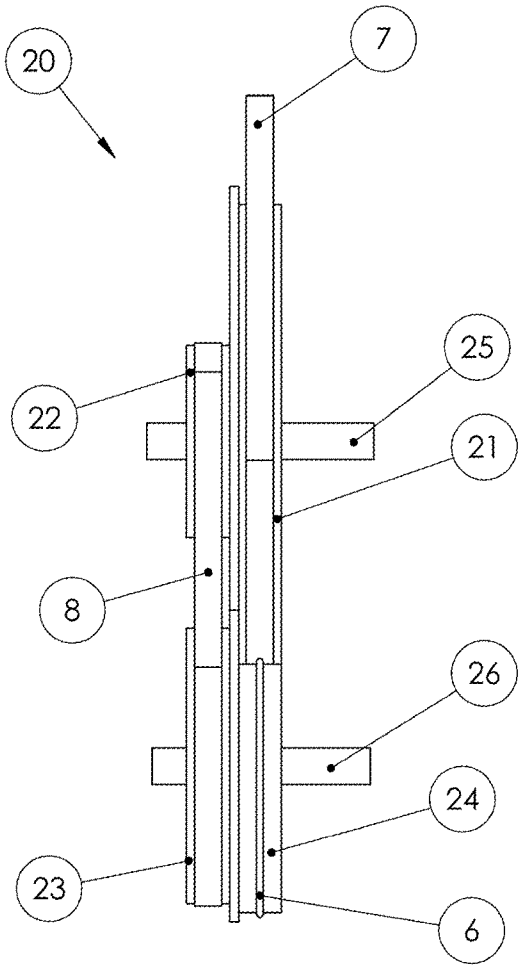
FIG. 8 is an isolated front view of a two axle version of the force reduction transmission assembly with variable force reduction.
Figure 10:
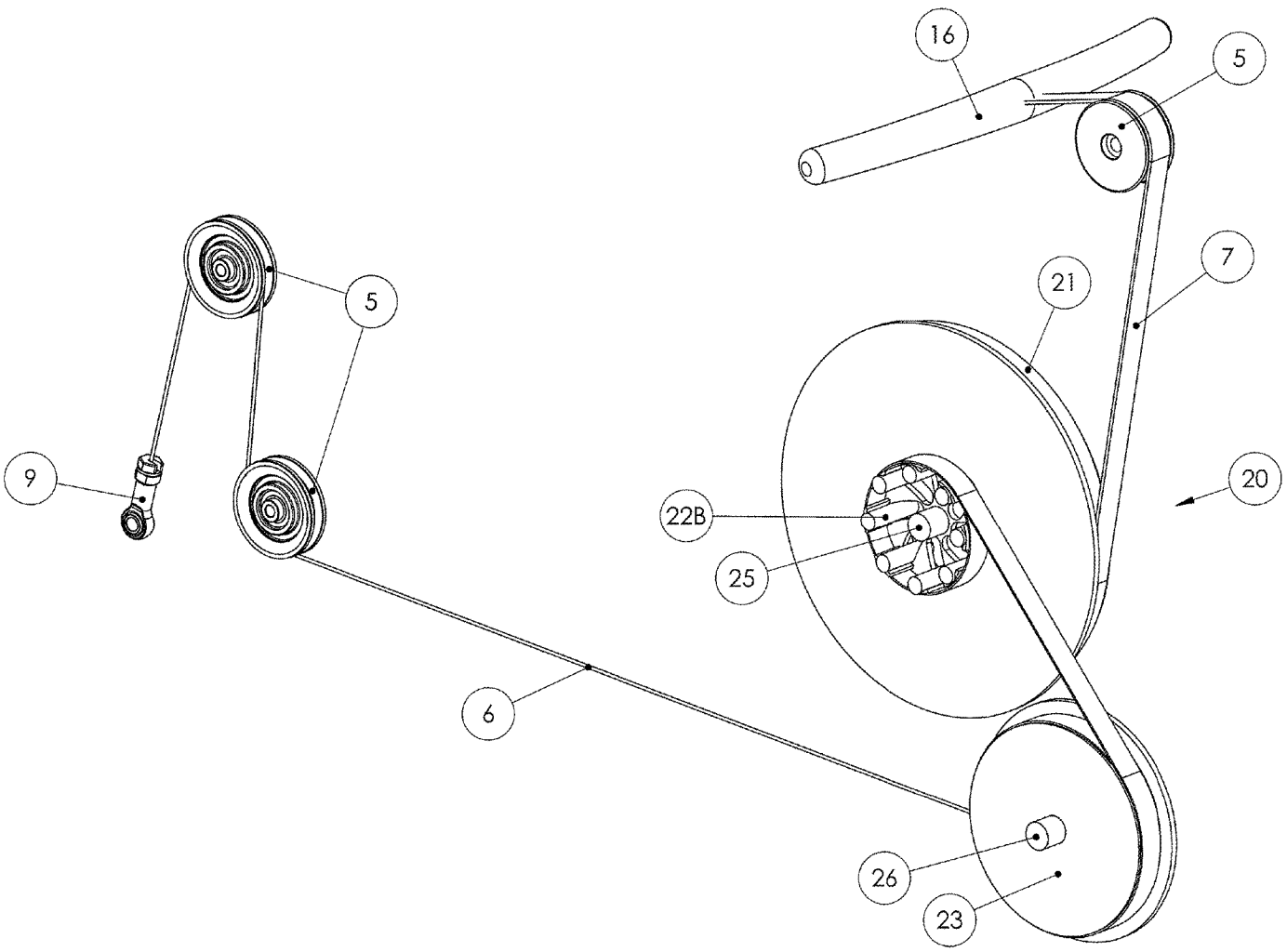
FIG. 10 is an isolated perspective view of the drive system with a two axle version of the force reduction transmission with adjustable force reduction wherein the force reduction is at a decreased setting.
Figure 11:
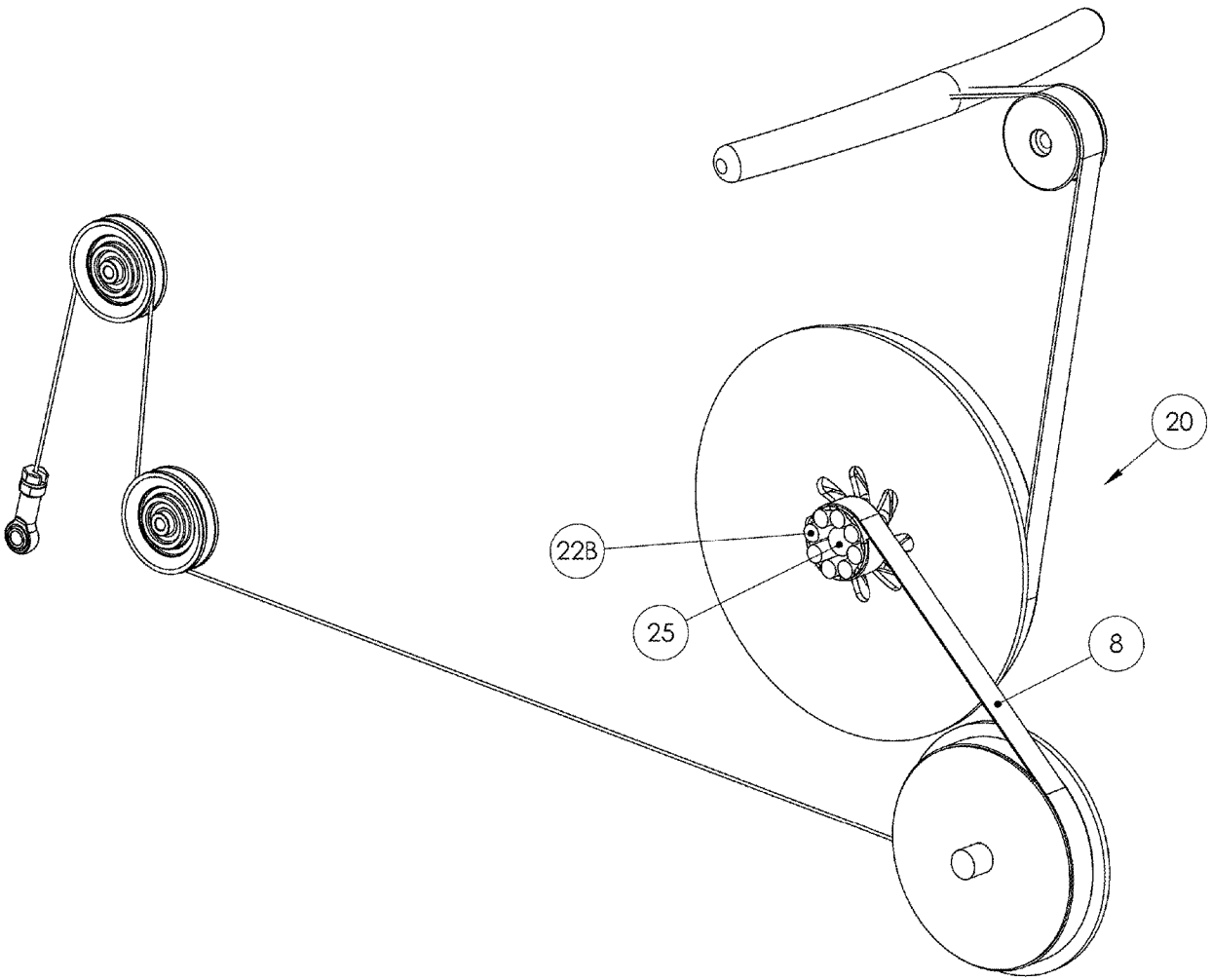
FIG. 11 is isolated perspective view of the drive system with a two axle version of the force reduction transmission with adjustable force reduction wherein the force reduction is at an increased setting.

In a second configuration, as illustrated in FIGS. 3-8, 10, and 11, transmission assembly 20 is comprised of a first axle 25, first take up drum 21, second take up drum 22, second axle 26, third take up drum 23, fourth take up drum 24, and third flexible member 8. This second configuration requires more components than the first configuration but the take up drums are substantially smaller that produce a similar amount of force reduction as the first configuration and this second configuration may fit better within base frame 2 and upper support structure 3 than the first configuration. Also, this second configuration offers more options for the alignment of the components of transmission assembly 20 with other operational components of machine 1. In this second configuration, all of the take up drums can be circular such that the reduction of force produced by the transmission assembly 20 is constant throughout the range of motion. Also in this configuration, the diameter of one of the take up drums can be adjustable as with adjustable second take up drum 22B as illustrated in FIGS. 10 and 11 such that the force required by user U to lift user support assembly 10 and user U can be increased or decreased. Also in this configuration, one of the take up drums can be cam shaped as with cam shaped fourth take up drum 24 as illustrated in FIGS. 7 and 8 such that the reduction of force produced by transmission assembly 20 is variable throughout the range of motion.

Figure 9:
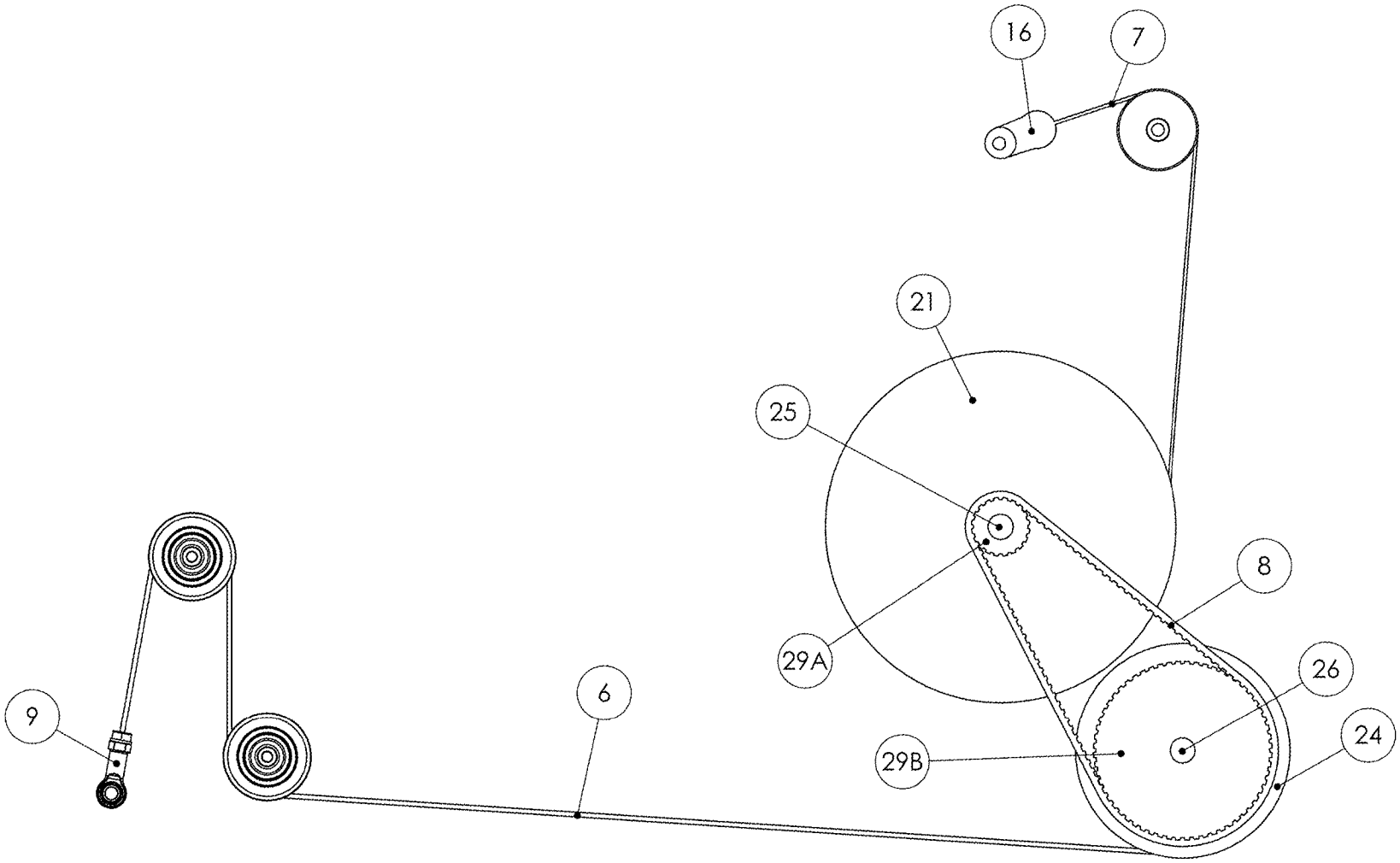
FIG. 9 is an isolated side view of the drive system with a two axle version of the force reduction transmission with constant force reduction.

In a third configuration, as illustrated in FIG. 9, transmission assembly 20 is comprised of a first axle 25, a first take up drum 21, a first transmission belt pulley 29A, a second axle 26, a second transmission belt pulley 29B, and a fourth take up 24 (not shown). This configuration is very similar to the second configuration with the exception that the third flexible member 8 is a continuous loop that rotates on first transmission belt pulley 29A and second transmission belt pulley 29B in place of the third flexible member 8 of the second configuration which has a first and second end and wraps on and off of second take up drum 22 and third take up drum 23.

Figure 15:
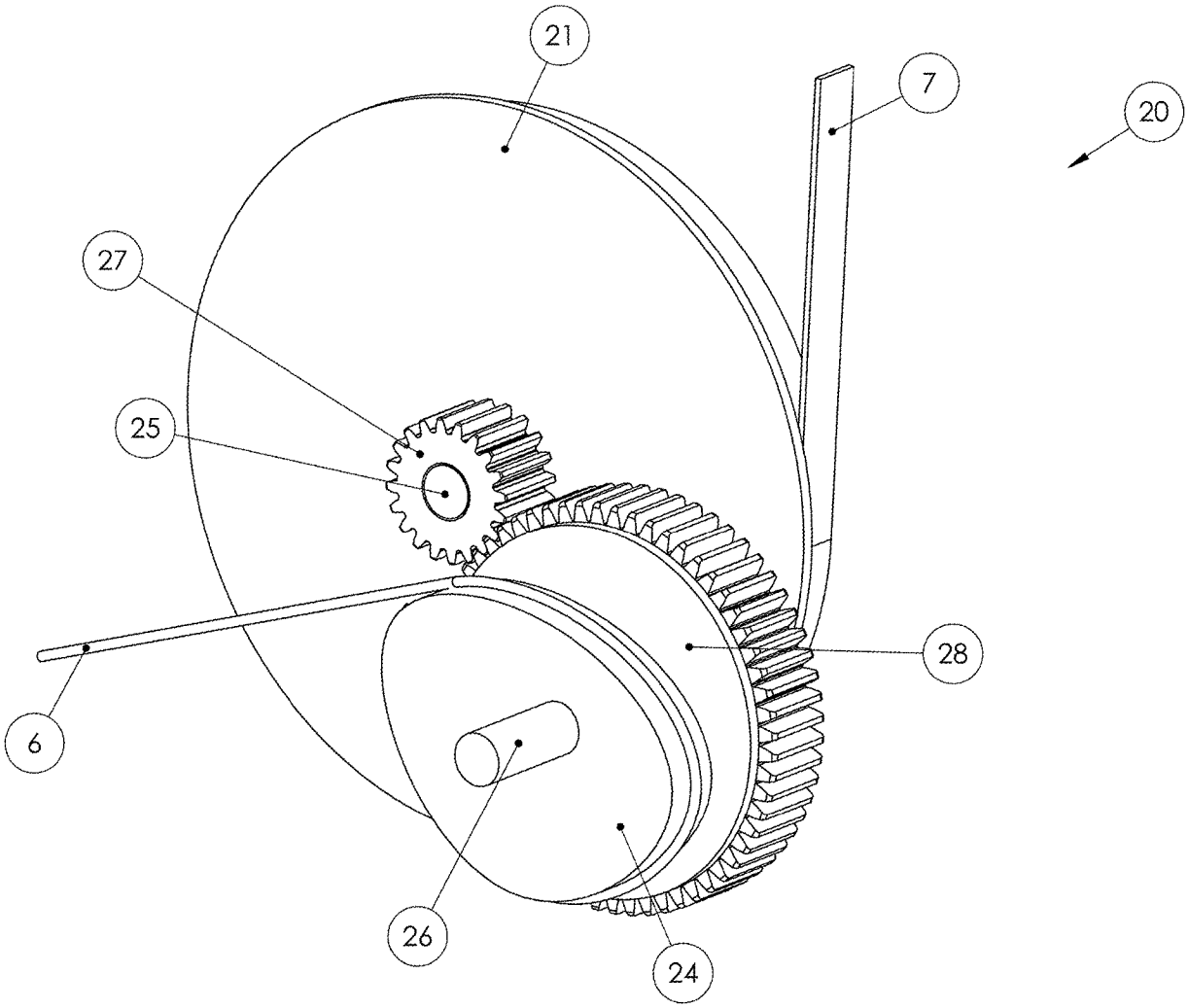
FIG. 15 is an isolated perspective view of a two axle version of the force reduction transmission assembly with variable force reduction.
Figure 16:
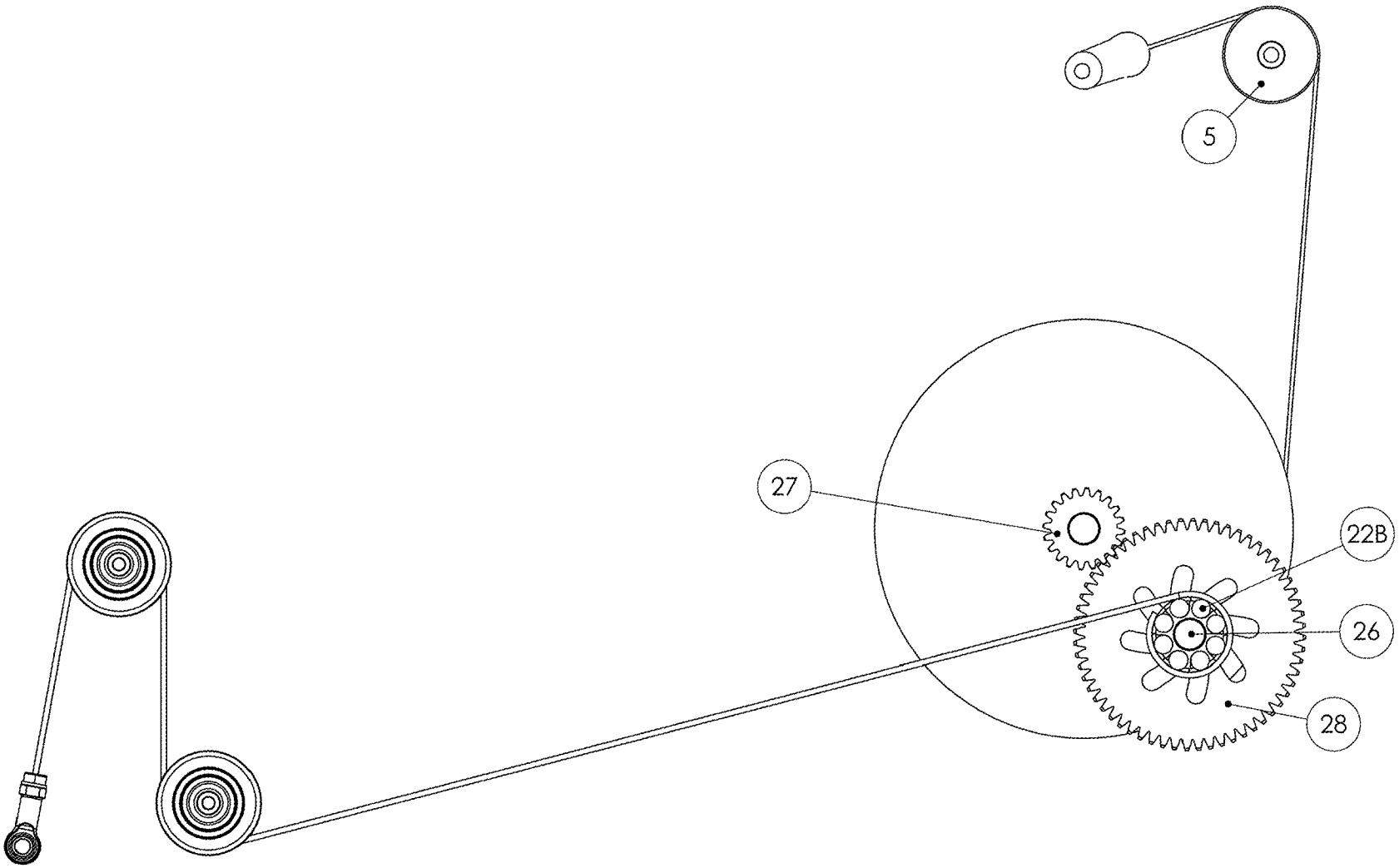
FIG. 16 is isolated side view of the drive system with a two axle version of the force reduction transmission with adjustable force reduction wherein the force reduction is at an increased setting.
Figure 17:
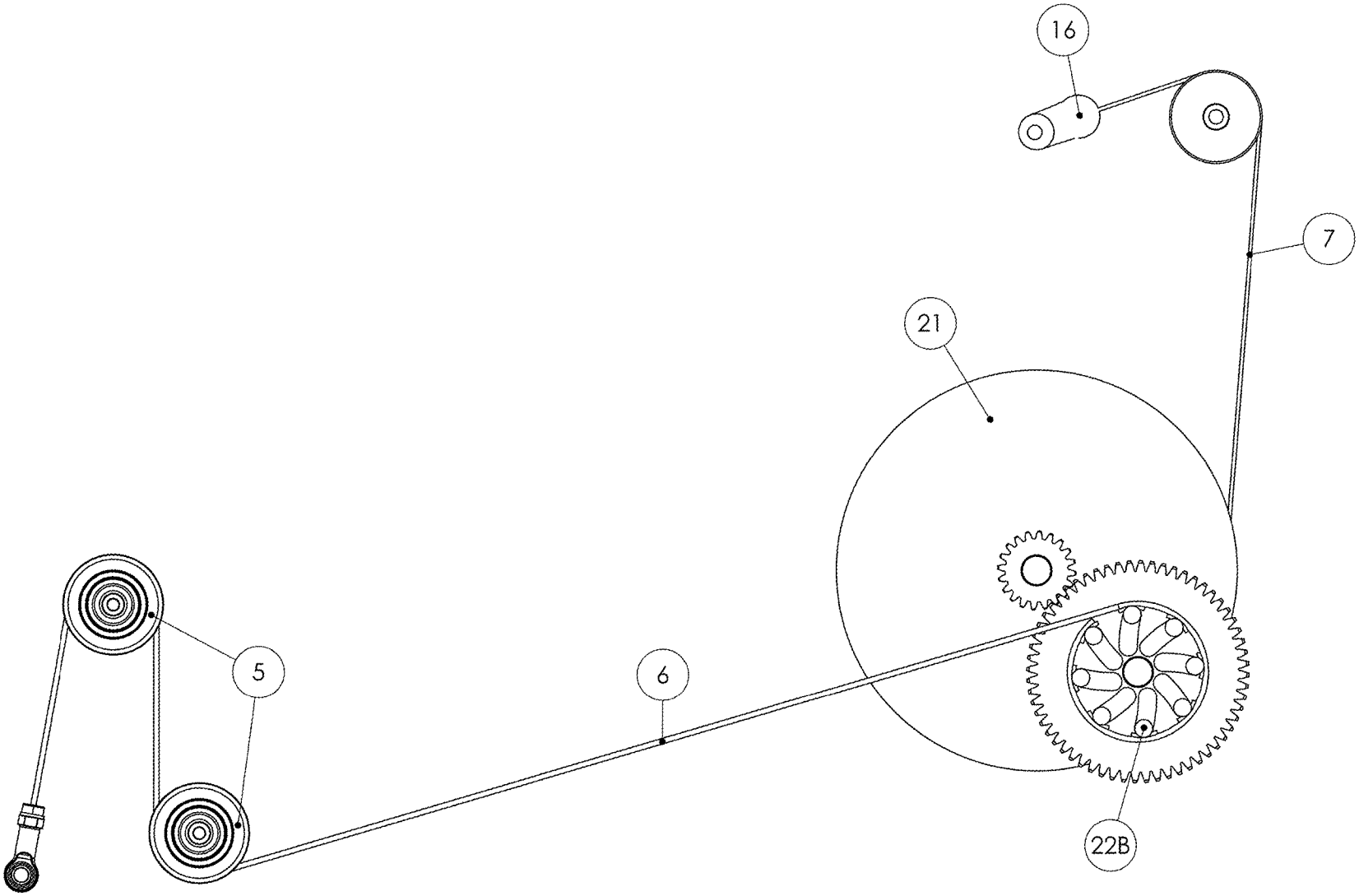
FIG. 17 is an isolated side view of the drive system with a two axle version of the force reduction transmission with adjustable force reduction wherein the force reduction is at a decreased setting.

In a fourth configuration, as illustrated in FIGS. 15-17, transmission assembly 20 is comprised of a first axle 25, first sprocket gear 27, second axle 26, second sprocket gear 28, and fourth take up drum 24 or adjustable second take up drum 22B. This configuration eliminates the need for a third flexible member 8 such that first sprocket gear 27 and second sprocket gear 28 have a direct drive connection. This configuration does, however, limit the alignment configurations between the transmission assembly 20 and the other operational components of machine 1. In this configuration one of the take up drums can be cam shaped as with cam shaped fourth take up drum 24 so as to vary the force reduction throughout the range of motion as illustrated in FIG. 15. Also in this configuration, the diameter of one of the take up drums can be adjustable such as adjustable take up drum 22B as illustrated in FIGS. 16 and 17 so as to increase or decrease the amount of force reduction.

Figure 18:
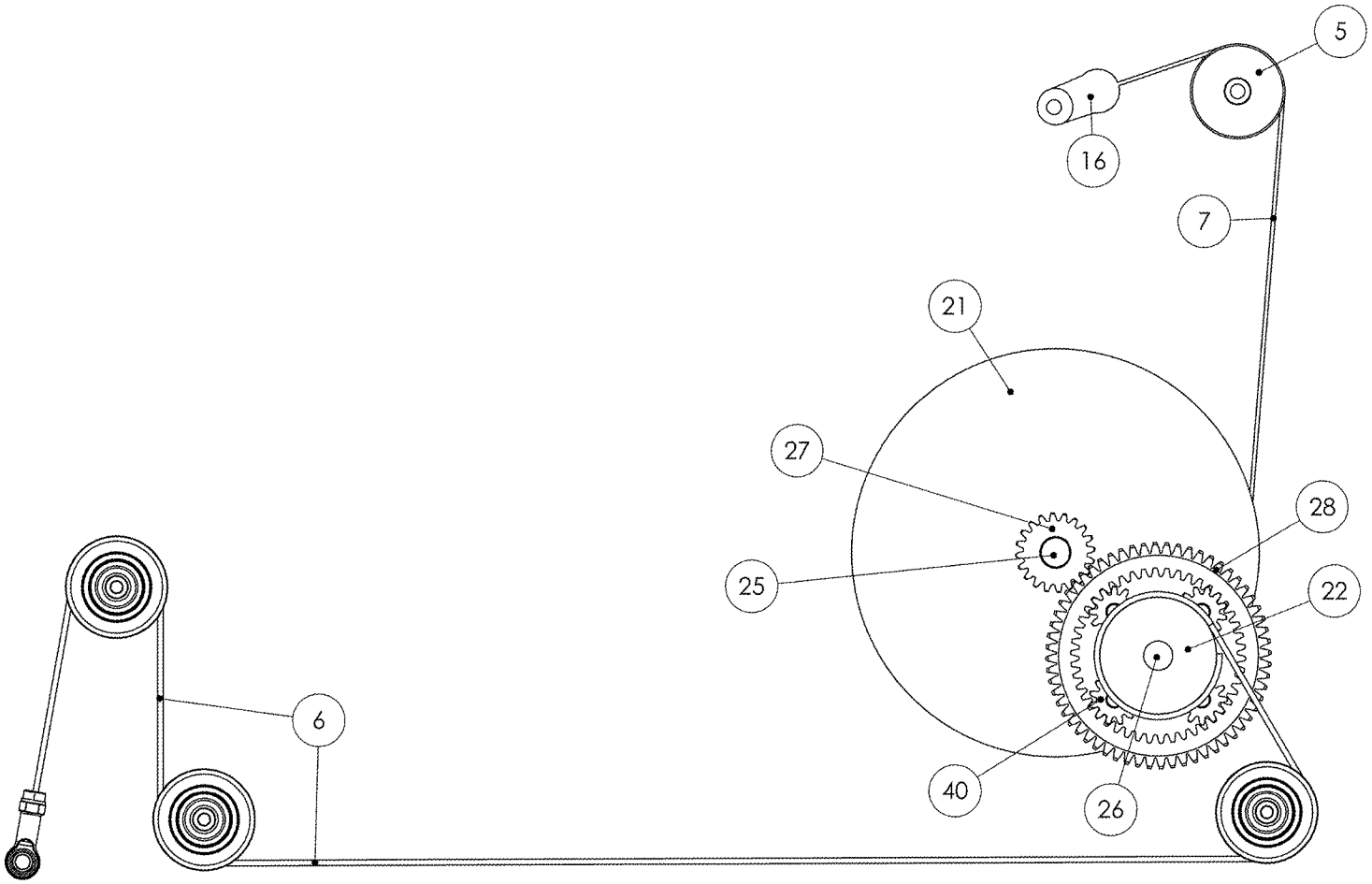
FIG. 18 is an isolated side view of the drive system with a two axle version of the force reduction transmission with adjustable force reduction.

In a fifth configuration, as illustrated in FIG. 18, transmission assembly 20 is comprised of a first axle 25, a first sprocket gear 27, a second axle 26, a second sprocket gear 28, a planetary gear assembly 40, and a second take up drum 22. This configuration works similar to the fourth configuration except the speed of rotation of second axle 26 is controlled by the planetary gear assembly 40 and planetary gear assembly 40 can be adjusted by user U prior to operation of machine 1 such that the force required by user U to lift user support assembly 10 and user U can be increased or decreased. The deficiencies of this configuration are that the planetary gear assembly has a limited set of gear ratios of adjustment and the alignment options of the components of transmission assembly 20 and the other operational components of machine 1 are limited.

In all preferred embodiments of the invention, the pulling force of user U is transferred to the rotatable force reduction transmission assembly 20 and from the rotatable force reduction transmission assembly 20 to the user support 10 via pulling handle 16, multiple guide pulleys 5, first flexible member 6, and second flexible member 7. In all of the illustrative figures, the first flexible member 6 is represented as a cable and all of the other flexible members are represented as belts; however, many other flexible member components such as chains, ropes and the like could be substituted for any of the flexible member components. In all preferred embodiments pulling handle 16 is connected to a first end of second flexible member 7 and is guided by at least one guide pulley 5 and the second end of flexible member 7 is operatively connected to first take up drum 21.

In the preferred embodiments, the first end of the first flexible member 6 is connected to the user support frame cable attachment bracket 13 with flexible member anchor 9 and is guided by multiple guide pulleys 5 and the second end of first flexible member 6 is operatively connected to a take up drum component of force reduction transmission assembly 20.

In an alternative embodiment, as illustrated is FIGS. 19-22, the first end of the first flexible member 6 is connected to lever support bar assembly 30 on first lever support bar 31 and is guided by multiple guide pulleys 5 and the second end of first flexible member 6 is operatively connected to a take up drum component of force reduction transmission assembly 20. Pulling handle 16 is represented as an elongated bar with first and second ends for gripping proximal to each end by user U but can be configured in multiple configurations suitable for gripping and pulling while performing a rowing simulation exercise. In the at rest and unactivated position, pulling handle 16 is supported by pulling handle receiver dock 4.

Figure 19:
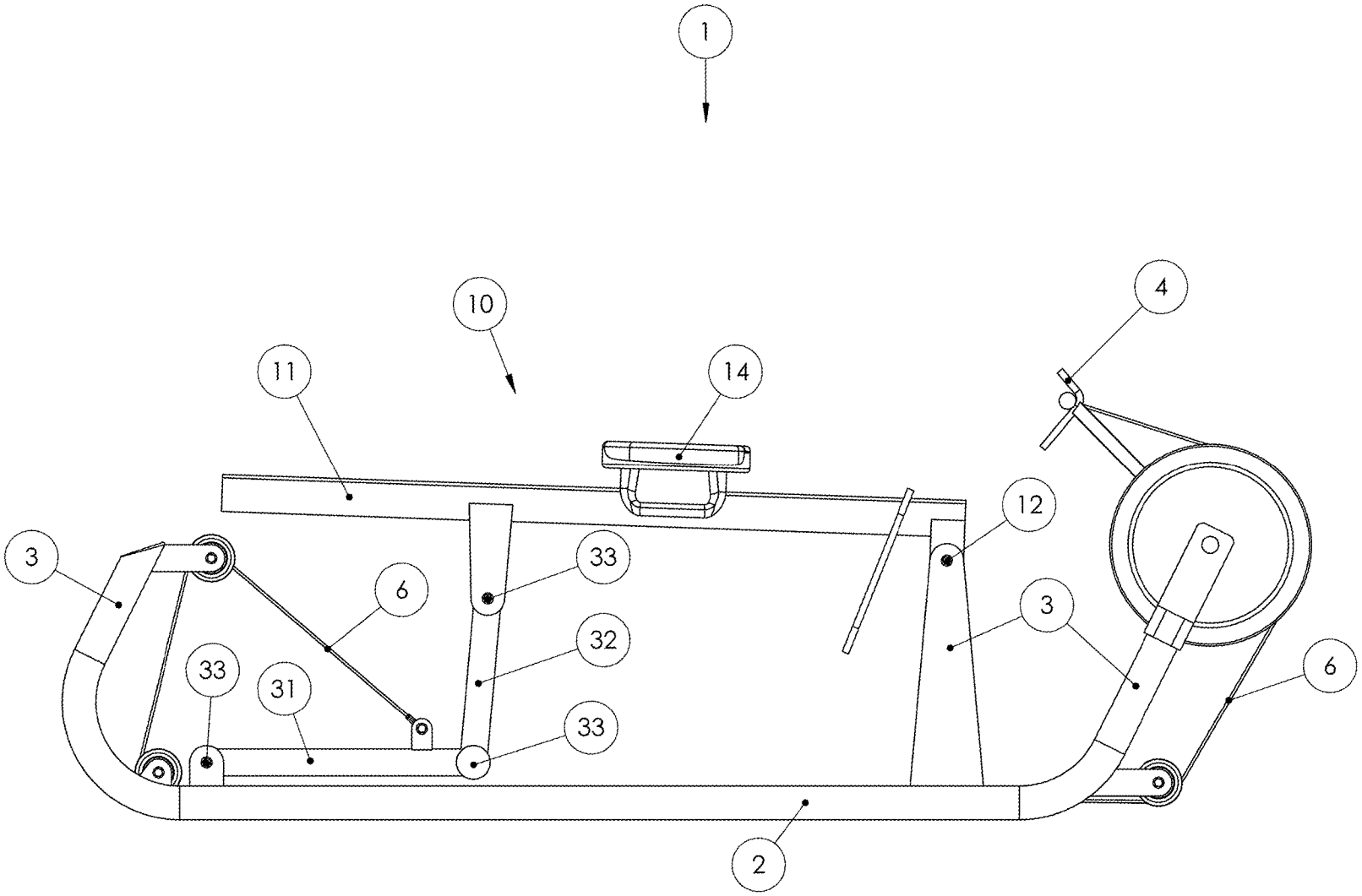
FIG. 19 is a side view of an alternative embodiment of the invention with a lever support bar assembly in the at rest an inactivated position.
Figure 20:
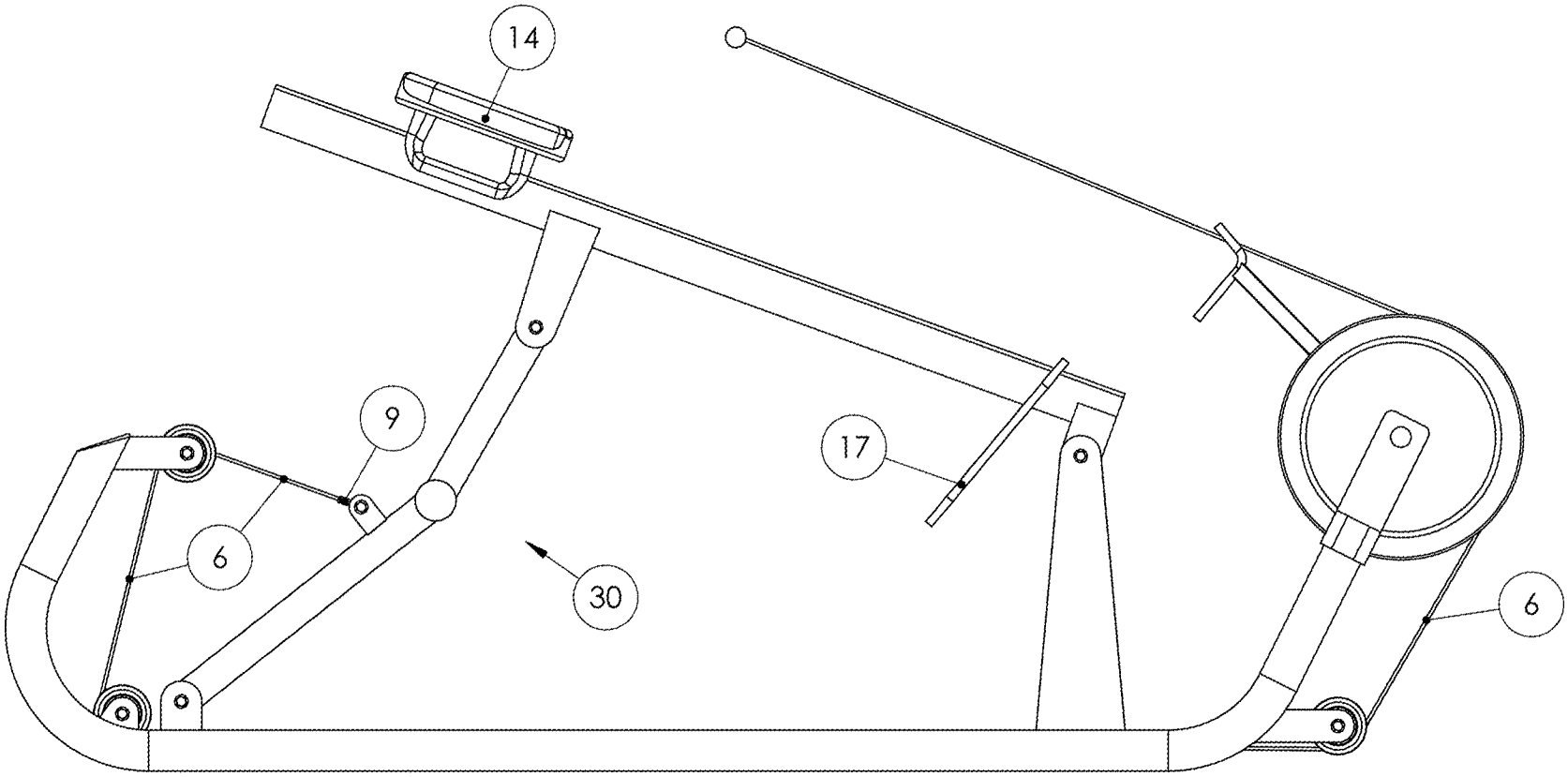
FIG. 20 is a side view of an alternative embodiment of the invention with a lever support bar assembly in the at engaged and activated position.
Figure 21:
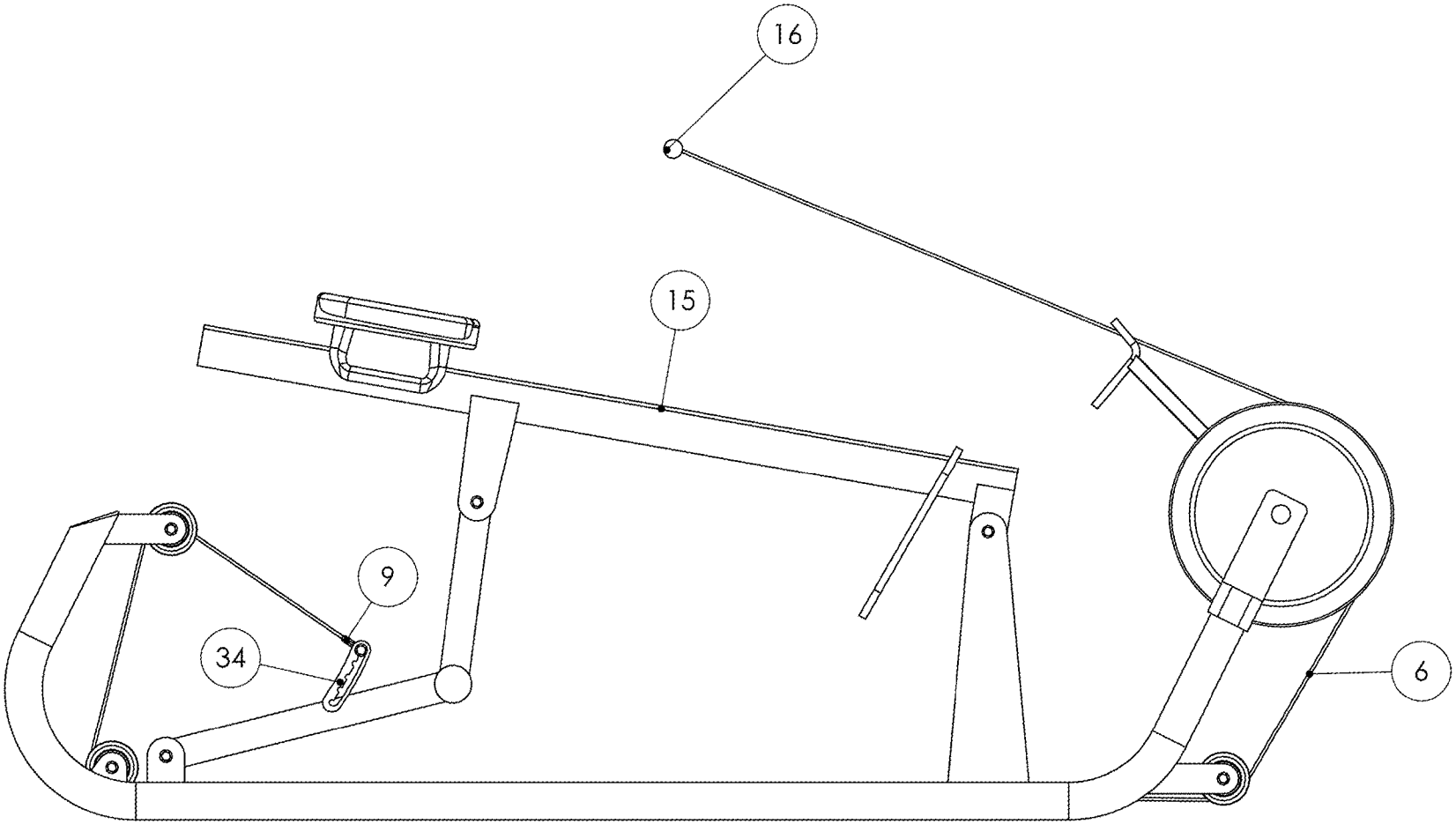
FIG. 21 is a side view of an alternative embodiment of the invention with an adjustable resistance lever support bar assembly in the engaged and activated position.

In an alternative embodiment of the invention, as illustrated in FIGS. 19-21, user support frame assembly 10 can be supported by lever support bar assembly 30 and lifted and lowered by lever support bar assembly 30 during operation of machine 1. Lever support bar assembly is comprised of first lever bar 31 and second lever support bar 32 and first lever support bar 31 and second lever support bar 32 are connected to each other and connected to base frame 2 and user support frame 11 with lever support bar pivots 33. In a second configuration of this alternative embodiment, first flexible member 6 can be connected to lever support bar assembly 30 at lever support bar assembly adjustment 34 with flexible cable anchor 9. In this second configuration of this alternative embodiment, the position of flexible cable anchor 9 can be adjusted so as to increase or decrease the pulling force required by user U on pulling handle 16 to lift user support assembly 10 and user U. In these two alternative embodiment configurations of the invention, any configuration of the rotatable force reduction transmission assembly 20 described herein can be combined with lever support bar assembly 30 and the other components of machine 1 to produce the rowing simulation exercise of machine 1 described herein.

Now referring to FIGS. 1, 2, 12, 13, and 14, which represent a single axle rotatable force reduction transmission assembly rowing simulator exercise machine, a horizontal base frame 2 is rigidly connected to and supports base frame upper support structures 3 and two guide pulleys 5 are mounted on a rearward vertical section of base frame upper support structure 3 and a guide pulley 5 is mounted on a forward portion of the base frame 2 and user support frame pivots 12 and first transmission axle 25 are mounted on opposing left and right angular portions of base frame upper support structure 3 and a guide pulley 5 is mounted on a horizontal portion of base frame upper support structure 3 and a pulling handle receiver dock 4 is mounted to a rearward end of said horizontal portion of base frame upper support structure 3 for storing pulling handle 16 when machine 1 is in the at rest and inactivated position. User support frame assembly 10 pivots about opposing left and right side user support frame pivots 12 during operation of machine 1 and user support frame assembly 10 is comprised of a user feet support 17 mounted to a forward portion of user support frame 11 for receiving a user's feet during operation of machine 1 and a user seat 14 for supporting a user's buttock is slidably engaged with seat slide surface 15 such that user seat 14 can freely slide backwards and forwards on user support frame 11 during operation of machine 1 and a user support cable attachment bracket 13 is rigidly mounted to a central lower portion of user support frame 11. First flexible member 6 has a first and second end and is connected at a first end to user support cable attachment bracket 13 with flexible member anchor 9 and is guided by three pulley guides 5 and connected at a second end to second take up drum 22 on rotatable force reduction transmission assembly 20 and second flexible member 7 has a first and second end and is connected at a first end to pulling handle 16 and connected at a second end to take up drum 21 on rotatable force reduction transmission assembly 20. Rotatable force reduction transmission assembly 20 rotates about first transmission axle 25 during operation of machine 1 and comprises first take up drum 21 and second take up drum 22 and first take up drum 21 and second take up drum 22 are rigidly connected such that they rotate in unison during operation of machine 1.

Now referring to FIGS. 3-8, 10, and 11, which represent a two axle rotatable force reduction transmission assembly rowing simulator exercise machine, a horizontal base frame 2 is rigidly connected to and supports base frame upper support structures 3 and two guide pulleys 5 are mounted on a rearward vertical section of base frame upper support structure 3 and a guide pulley 5 is mounted on a forward portion of the base frame 2 and user support frame pivots 12 and first transmission axle 25 are mounted on a first set of opposing left and right angular portions of base frame upper support structure 3 and second transmission axle 26 is mounted on a second set of opposing left and right angular portions of base frame upper support structure 3 and a guide pulley 5 is mounted on a horizontal portion of base frame upper support structure 3 and a pulling handle receiver dock 4 is mounted to a rearward end of said horizontal portion of base frame upper support structure 3 for storing pulling handle 16 when machine 1 is in the at rest and inactivated position. User support frame assembly 10 pivots about opposing left and right side user support frame pivots 12 during operation of machine 1 and user support frame assembly 10 is comprised of a user feet support 17 mounted to a forward portion of user support frame 11 for receiving a user's feet during operation of machine 1 and a user seat 14 for supporting a user's buttock is slidably engaged with seat slide surface 15 such that user seat 14 can freely slide backwards and forwards on user support frame 11 during operation of machine 1 and a user support cable attachment bracket 13 is rigidly mounted to a central lower portion of user support frame 11. First flexible member 6 has a first and second end and is connected at a first end to user support cable attachment bracket 13 with flexible member anchor 9 and is guided by three pulley guides 5 and connected at a second end to fourth take up drum 24 on rotatable force reduction transmission assembly 20 and second flexible member 7 has a first and second end and is connected at a first end to pulling handle 16 and connected at a second end to take up drum 21 on rotatable force reduction transmission assembly 20. Rotatable force reduction transmission assembly 20 rotates about first transmission axle 25 and second transmission axle 26 during operation of machine 1 and comprises first take up drum 21, second take up drum 22, third take up drum 23, fourth take up drum 24 and third flexible member 8 and first take up drum 21 and second take up drum 22 are rigidly connected such that they rotate in unison during operation of machine 1 and third take up drum 23 and fourth take up drum 24 are rigidly connected and rotate in unison during operation of machine 1 and second take up drum 22 and third take up drum 23 are connected by first and second ends of third flexible member 8 such that first take up drum 21, second take up drum 22, third take up drum 23 and fourth take up drum 24 rotate simultaneously during operation of machine 1.

Now referring to FIGS. 7 and 8, what is shown is an isolated view of a two axle and four drum version of the rotatable force reduction transmission assembly 20 configured such that each of the drums are sized to produce the performance requirements of the machine 1 and create a mechanical advantage that is applied to the pulling handle 16 such that the force required by the user to lift the user support frame assembly 10 and the user U is reduced wherein first take up drum 21 and second take up drum 22 are rigidly connected and rotate in unison on first axle 25 during operation of machine 1 and third take up drum 23 and fourth take up drum 24 are rigidly connected and rotate in unison on second axle 26 during operation of machine 1 and second flexible member 7 wraps on and off of first take up drum 21 during operation of machine 1 and first flexible member 6 wraps on and off of fourth take up drum 24 during operation of machine 1 and third flexible member 8 has a first and second end and a first end of third flexible member 8 is connected to second take up drum 22 and a second end of third flexible member 8 is connected to third take up drum 23 and third flexible member 8 wraps on and off of second take up drum 22 and third take up drum 23 in a reciprocating motion during operation of machine 1.

Now referring to FIG. 9 what is shown is an isolated view of a drive system of machine 1 wherein a two axles, a two take up drums and two transmission belt pulleys version of the rotatable force reduction transmission assembly 20 is configured such that each of the drums and belt pulleys are sized to produce the performance requirements of the machine 1 and create a mechanical advantage that is applied to the pulling handle 16 such that the force required by the user to lift the user support frame assembly 10 and the user U is reduced wherein first take up drum 21 and first transmission belt pulley 29A are rigidly connected and rotate in unison on first axle 25 during operation of machine 1 and second transmission belt pulley 29B and fourth take up drum 24 are rigidly connected and rotate in unison on second axle 26 during operation of machine 1 and second flexible member 7 wraps on and off of first take up drum 21 during operation of machine 1 and first flexible member 6 wraps on and off of fourth take up drum 24 during operation of machine 1 and third flexible member 8 is a continuous loop belt that rotates on first transmission belt pulley 29A and second transmission belt pulley 29B in a reciprocating motion during operation of machine 1.

Now referring to FIGS. 10 and 11, what is shown is an isolated view of a drive system of machine 1 wherein a two axle and four take up drums rotatable force reduction transmission assembly 20 reduces the force required by user U to lift user support assembly 10 and user U. In these figures, the transmission assembly is adjustable and is represented wherein the diameter of the second take up drum 22B can be increased or decreased such as to increase or decrease the force require by user U to lift user support frame assembly 10 and user U. In this embodiment the second take up drum 22B is comprised of multiple rods that are mechanically linked and form a circular shape such that they can be manipulated with an adjustment mechanism such as a dial, lever or similar component to expand or contract while keeping a circular shape so as to form a larger or smaller circle for third flexible member 8 to wrap and unwrap upon and therefore change the ration of movement of first flexible member 6 relative to second flexible member 7 so and to increase or decrease the amount of force required by user U to lift user support frame 10 and user U during operation of machine 1. FIG. 10 represents a larger diameter adjustable second take up drum 22B and thus would require more force by user U to lift user support assembly 10 and user U and FIG. 11 represents a smaller diameter adjustable second take up drum 22B and thus would require less force by user U to lift user support assembly 10 and user U and adjustable second take up drum 22B can be adjusted and set to various size diameters anywhere in between the largest to smallest settings prior to operation of machine 1.

Now referring to FIG. 12, what is shown is an isolated view of a drive system of machine 1 which utilizes a single axle and two take drum rotatable force reduction transmission assembly 20 to vary the force required by user U to lift user support assembly 10 and user U during operation of machine 1 wherein a first take up drum 21 and a cam shaped second take up drum 22C are rigidly connected and rotate in unison on first axle 25 during operation of machine 1 and the non-circular shape of second take up drum 22C causes the rate of movement of first flexible member 6 relative to the rate of movement of second flexible member 7 to increase or decrease throughout the range of motion during operation of machine 1 such that the amount of force reduction produced by the transmission assembly 20 increases or decreases throughout the range of motion during operation of machine 10.

Now referring to FIGS. 13 and 14, what is shown is an isolated view of the drive system of machine 1 wherein a single axle and two take up drums rotatable force reduction transmission assembly reduces the force required by user U to lift user support assembly 10 and user U during operation of machine 1. In these figures, the transmission assembly is adjustable and is represented wherein the diameter of the second take up drum 22B can be increased or decreased such as to increase or decrease the force require by user U to lift user support frame assembly 10 and user U. In this embodiment the second take up drum 22B is comprised of multiple rods that are mechanically linked and form a circular shape such that they can be manipulated with an adjustment mechanism such as a dial, lever or similar component to expand or contract while keeping a circular shape so as to form a larger or smaller circle for first flexible member 6 to wrap and unwrap upon and therefore change the ratio of movement of first flexible member 6 relative to second flexible member 7 so and to increase or decrease the amount of force required by user U to lift user support frame 10 and user U during operation of machine 1. FIG. 13 represents a larger diameter adjustable second take up drum 22B and thus would require more force by user U to lift user support assembly 10 and user U and FIG. 14 represents a smaller diameter adjustable second take up drum 22B and thus would require less force by user U to lift user support assembly 10 and user U and adjustable second take up drum can be adjusted and set to various size diameters anywhere in between the largest to smallest settings prior to operation of machine 1.

Now referring to FIG. 15, what is shown is an isolated view of a two axle, two drum and two sprocket gears version of the rotatable force reduction transmission assembly 20 configured such that each of the drums and each of the sprocket gears are sized to produce the performance requirements of the machine 1 and create a mechanical advantage that is applied to the pulling handle 16 such that the force required by the user to lift the user support frame assembly 10 and the user U is reduced wherein first take up drum 21 and first sprocket gear 27 are rigidly connected and rotate in unison on first axle 25 during operation of machine 1 and second sprocket gear 28 and cam shaped fourth take up drum 24 are rigidly connected and rotate in unison on second axle 26 during operation of machine 1 and second flexible member 7 wraps on and off of first take up drum 21 during operation of machine 1 and first flexible member 6 wraps on and off of fourth take up drum 24 during operation of machine 1 and first sprocket gear 27 and second sprocket gear 28 are operatively engaged such that the rotation of either sprocket causes the other sprocket to rotate in the opposite direction during operation of machine 1 and the non-circular shape of cam shaped fourth take up drum 24 will vary the force reduction of transmission assembly 20 throughout the range of motion of the operation of machine 1.

Now referring to FIGS. 16 and 17, what is shown is an isolated view of a drive system of machine 1 wherein a two axle, two take up drums and two sprocket gears rotatable force reduction transmission assembly 20 reduces the force required by user U to lift user support assembly 10 and user U. This transmission assembly is similar to the transmission assembly in FIG. 15; however, in these figures the transmission assembly is adjustable and is represented such that cam shaped fourth take up drum 24 is replaced with an adjustable circular second take up drum 22B that can be adjusting in diameter to increased or decreased the force require by user U to lift user support frame assembly 10 and user U. In this embodiment the second take up drum 22B is comprised of multiple rods that are mechanically linked and form a circular shape such that they can be manipulated with an adjustment mechanism such as a dial, lever or similar component to expand or contract while keeping a circular shape so as to form a larger or smaller circle for first flexible member 6 to wrap and unwrap upon and therefore change the ration of movement of first flexible member 6 relative to second flexible member 7 so and to increase or decrease the amount of force required by user U to lift user support frame 10 and user U during operation of machine 1. FIG. 16 represents a smaller diameter adjustable second take up drum 22B and thus would require less force by user U to lift user support assembly 10 and user U and FIG. 17 represents a larger diameter adjustable second take up drum 22B and thus would require more force by user U to lift user support assembly 10 and user U and adjustable second take up drum 22B can be adjusted and set to various size diameters anywhere in between the largest to smallest settings prior to operation of machine 1.

Now referring to FIG. 18, what is shown is an isolated view of a drive system of machine 1 wherein a two axle, two take up drums, two sprocket gears and an adjustable planetary gear assembly force reduction transmission assembly 20 reduces the force required by user U to lift user support assembly 10 and user U. In this transmission assembly, the diameter of the second take up drum 22 is non-adjustable and the ratio of movement of second flexible member 7 relative to first flexible member 6 is controlled by the speed of rotation of second axle 26 which is controlled by the motion of planetary gear assembly 40 such that first take up drum 21 and first sprocket gear 27 are rigidly connected and rotate on first axle 25 in unison during operation of machine 1 and second take up drum 22 is connected to second axle 26 and planetary gear assembly 40 is connected to second axle 26 and planetary gear assembly 40 is operatively engaged with second sprocket gear 28 which is operatively engaged with first sprocket gear 27 such that second sprocket gear 28 transfers the rotational force between first sprocket gear 27 and planetary gear assembly 40 during operation of machine 1 and planetary gear assembly 40 can be set to various speeds prior to operation of machine 1 to increase or decrease the force required by user U to lift user support assembly 10 and User U during operation of machine 1.

Now referring to FIGS. 19 and 20, what is shown is an alternative embodiment of the invention with a single axle rotatable force reduction transmission assembly and lever support bar assembly rowing simulator exercise machine in which a horizontal base frame 2 is rigidly connected to and supports base frame upper support structures 3 and two guide pulleys 5 are mounted on a rearward vertical section of base frame upper support structure 3 and a guide pulley 5 is mounted on a forward portion of the base frame upper support structure 3 and user support frame pivots 12 and first transmission axle 25 are mounted on forward portions of base frame upper support structure 3 and a pulling handle receiver dock 4 is mounted to a rotatable force reduction transmission assembly 20 for storing pulling handle 16 when machine 1 is in the at rest and inactivated position. User support frame assembly 10 pivots about user support frame pivots 12 during operation of machine 1 and user support frame assembly 10 is comprised of a user feet support 17 mounted to a forward portion of user support frame 11 for receiving a user's feet during operation of machine 1 and a user seat 14 for supporting a user's buttock is slidably engaged with seat slide surface 15 such that user seat 14 can freely slide backwards and forwards on user support frame 11 during operation of machine 1 and a lever support bar assembly 30 supports the rearward portion of user support frame assembly 10 and connects user support frame assembly 10 to base frame 2 with first lever support bar 31 and second lever support bar 32 and lever support bar 31 and lever support bar 32 pivot on lever support bar pivots 33 during operation of machine 1 to lift the rearward portion of user support frame assembly 10 as it rotates about user support frame pivot 12 during operation of machine 1. First flexible member 6 has a first and second end and is connected at a first end to lever support bar cable attachment bracket 35 with flexible member anchor 9 and is guided by three pulley guides 5 and connected at a second end to rotatable force reduction transmission assembly 20 and second flexible member 7 has a first and second end and is connected at a first end to pulling handle 16 and connected at a second end to rotatable force reduction transmission assembly 20 and rotatable force reduction transmission assembly 20 rotates about first transmission axle 25 during operation of machine 1. In this lever support bar assembly alternative embodiment of the invention, the rotatable force reduction transmission assembly could be eliminated and replaced with a one or more guide pulleys and one of the flexible members could be eliminated such that a first end of first flexible member 6 is connected to the lever bar support assembly 30 and the second end of first flexible member 6 is connected to pulling handle 16 such that the force required to lift the user support and user U could be reduced and controlled by the lever bar support assembly 30.

Figure 22:
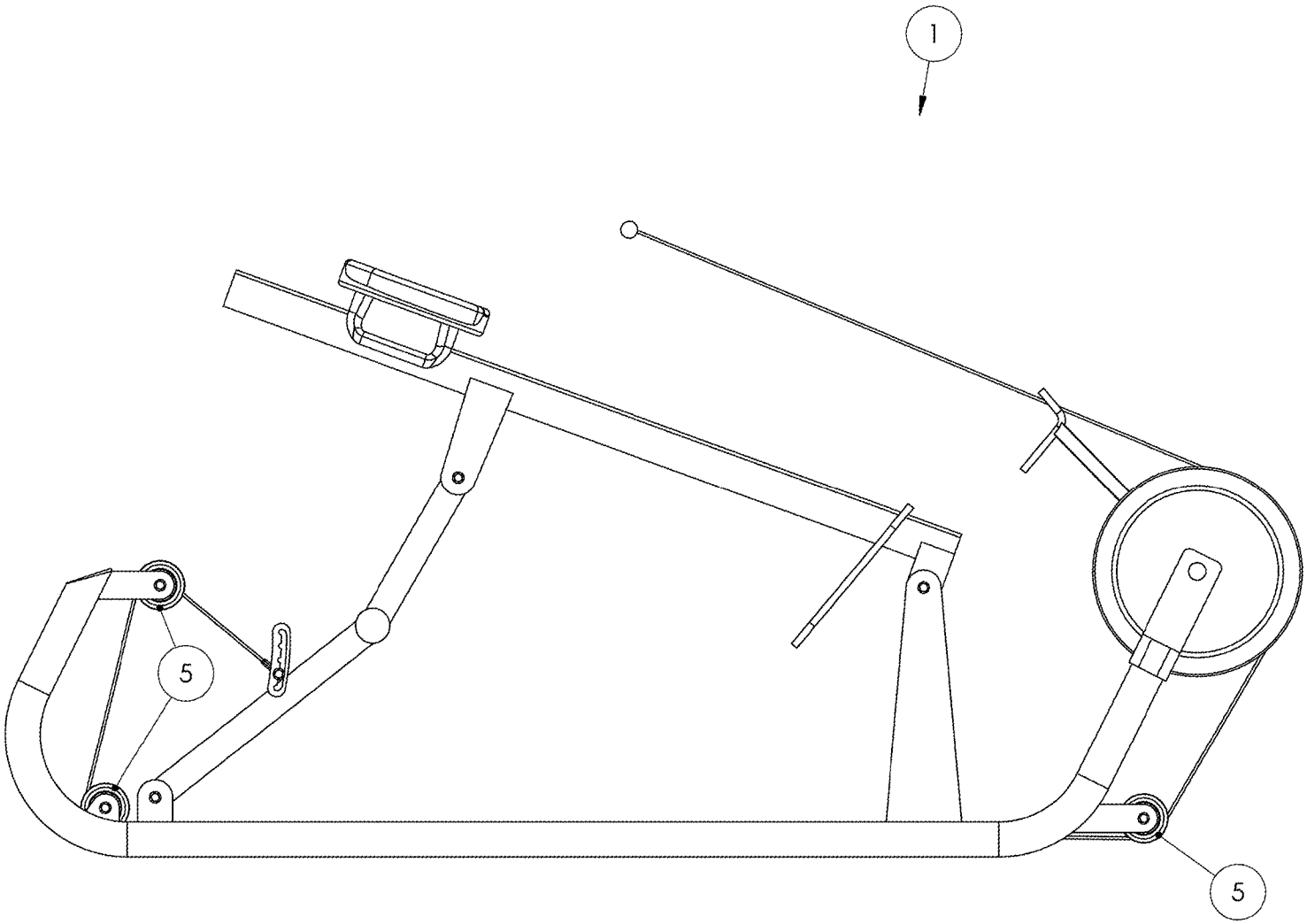
FIG. 22 is a side view of an alternative embodiment of the invention with an adjustable lever support bar assembly in the engaged and activated position.

Now referring to FIGS. 21 and 22, what is shown is an alternative embodiment of the invention with a single axle rotatable force reduction transmission assembly and lever support bar assembly rowing simulator exercise machine. This embodiment is identical to the embodiment represented in FIGS. 19 and 20 with the exception that lever support bar cable attachment bracket 35 has been replaced with lever support bar assembly adjustment bracket 34 such that the force required by user U to lift user support frame assembly 10 and user U can be adjusted by user U prior to operation of machine 1 by moving the location of flexible member anchor 9 on lever support bar assembly adjustment bracket 34. Lever support bar assembly adjustment bracket 34 is located on lever support bar 31 and lever support bar 31 has a first end and a second end and the first end is pivotally connected to base frame 2 and the second end is pivotally connected to lever support bar 32 and when flexible member anchor 9 is connected more proximal to the first end of lever bar 31 on lever support bar assembly adjustment bracket 34 the force required by user U to lift user support frame 10 and user U is increased and when flexible member anchor 9 is connected more distal to the first end of lever bar 31 on lever support bar assembly adjustment bracket 34 the force required by user U to lift user support frame 10 and user U is decreased. In this lever support bar assembly alternative embodiment of the invention, the rotatable force reduction transmission assembly could be eliminated and replaced with a one or more guide pulleys and one of the flexible members could be eliminated such that a first end of first flexible member 6 is connected to the lever bar support assembly 30 and the second end of first flexible member 6 is connected to pulling handle 16 such that the force required to lift the user support and user U could be reduced and controlled by the lever bar support assembly 30.

To operate the invention, user U mounts the machine 1 by assuming a seated position on user seat 14 and places his or her feet on feet support surface 17 with a bent knee positon such that user U's hips are proximal to user U's feet. User U then grasp pulling handle 16 and pulls it away from receiver dock 14 with an extended arm position while simultaneously pushing his or her feet against feet support surface 17 to begin moving his or her legs leg into an extended position so as to move user U's hips away from user U's feet while simultaneously moving pulling handle 16 towards his or her torso so as to begin moving his or her arms into a bent elbow contracted position. This motion causes user seat 14 to move rearward on seat slide rail 15 and away from pulling handle receiver dock 4 and this rearward movement of pulling handle 16 causes the rearward movement of first end of second flexible member 7 which causes the second end portion of second flexible member 7 to unwrap off of force reduction transmission assembly 20 as it causes force reduction transmission assembly 20 to rotate which causes the second end portion of first flexible member 6 to wrap onto force reduction transmission assembly 20 and causes the first end of first flexible member 6 to move upward causing the rearward portion of user support frame assembly 10 to lift in an arcing motion as it pivots about user support frame pivot 12.

When user U has fully extended his or her legs and fully contracted his or her arms into a bent elbow position and handle 16 is most proximal to user U's torso, machine 1 is in the engaged and fully activated position.

When user U reduces the pulley force on pulling handle 16 so as to begin moving pulling handle 16 away from user U's torso and begins moving his or her arms into an extended arm position while simultaneously reducing the pushing force on his or her feet against feet support surface 17 to begin moving his or her legs leg into a bent knee contacted position so as to move user U's hips towards user U's feet, this motion causes user seat 14 to move forward on seat slide rail 15 towards pulling handle receiver dock 4 and the forward movement of pulling handle 16 causes the forward movement of first end of second flexible member 7 which causes the second end portion of second flexible member 7 to wrap onto force reduction transmission assembly 20 as it causes force reduction transmission assembly 20 to rotate in the opposite direction which causes the second end portion of first flexible member 6 to unwrap off of force reduction transmission assembly 20 causing the first end of first flexible member 6 to move downward causing the rearward portion of user support frame assembly 10 to lower in an arcing motion as it pivots about user support frame pivot 12.

When user U has fully contracted his or her legs in a bent knee position and fully extended his or her arms and pulling handle 16 is docked in pulling handle receiver dock 4, machine 1 is in the at rest and inactivated position.

If machine 1 is equipped with an adjustable configuration of the rotatable force reduction transmission assembly 20, user U would adjust the setting of force reduction of the transmission assembly 20 to the desired ratio of force reduction prior to operating machine 1.

User U can move pulling handle 16 any distance between the at rest and inactivated position and the engaged and fully activated position and hold pulling handle 16 at any position between the at rest and inactivated position and the engaged and fully activated position during the operation of machine 10.

User U can perform multiple repetitions of exerting and releasing the force required to operate machine 10 so as to perform a set or duration of strength and cardiovascular conditioning rowing simulated exercise.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

LISTING OF REFERENCE NUMERALS

No. Description
U User
1 Machine
2 Base frame
3 Base frame upper support structure
4 Pulling handle receiver dock
5 Guide pulley
6 First flexible member
7 Second flexible member
8 Third flexible member
9 Flexible member anchor
10 User support frame assembly
11 User support frame
12 User support frame pivot
13 User support frame cable attachment bracket
14 User seat
15 Seat slide rail
16 Pulling handle
17 User feet support
20 Rotatable force reduction transmission assembly
21 First take up drum
22 Second take up drum
22B Adjustable second take up drum
22C Cam shaped second take up drum
23 Third take up drum
24 Cam shaped Fourth take up drum
25 First transmission axle
26 Second transmission axle
27 First sprocket gear
28 Second sprocket gear
29A First transmission belt pulley

29B Second transmission belt pulley
30 Lever support bar assembly
31 First lever support bar
32 Second lever support bar
33 Lever support bar pivot
34 Lever support bar assembly adjustment bracket
35 Lever support bar cable attachment bracket
40 Planetary gear assembly

What is claimed is:

1. A body weight resistance rowing simulator exercise machine with a force reduction transmission comprising:

a) a horizontal stationary base frame having a forward end and a rearward end;

b) a movable user support frame assembly having a forward end and a rearward end;

c) a rotatable force reduction transmission assembly mounted at a fixed position on the base frame;

d) a first flexible member having a first end and a second end, wherein the first end of the first flexible member is connected to a central or rearward portion of the user support frame assembly and wherein the second end of the first flexible member is connected to the force reduction transmission assembly;

e) a forward pivot, wherein a forward portion of the user support frame assembly is pivotally connected to and supported on the base frame by the forward pivot at a position proximal to the forward end of the user support frame assembly and the forward end of the base frame;

f) a guide pulley assembly, wherein another portion of the user support frame assembly that is not supported on the base frame by the forward pivot is supported on the base frame by the first flexible member and the guide pulley assembly, whereby the user support frame assembly is in a substantially horizontal position when the machine is in an at rest and inactivated position;

g) a user seat slidably mounted on the user support frame;

h) a user feet support surface rigidly mounted on the forward portion of the user support frame assembly; and i) a second flexible member having a first end and a second end, wherein the first end of the second flexible member is connected to a pulling handle and the second end of the second flexible member is connected to the force reduction transmission assembly, whereby a reciprocal motion of the pulling handle by a user while a user slides the user seat forwards and backwards on the user support frame assembly simulates a rowing exercise motion.

2. The exercise machine of claim 1, wherein when a user imparts a pulling force on the pulling handle in a pulling direction towards a rearward end of the machine, this causes rotation of the force reduction transmission assembly in a first rotation direction, simultaneously causing the first end of the first flexible member to move upward, thereby lifting the rearward end of the user support frame assembly such that the rearward end of the user support frame assembly increases in elevation relative to the elevation of the forward pivot thereby causing the user support frame assembly to pivot upwards from the forward end of the user support frame assembly to the rearward end of the user support frame assembly such that the user support frame assembly is in supporting contact with the base frame only by the forward pivot.

3. The exercise machine of claim 2, wherein when a user reduces the pulling force on the pulling handle allowing the pulling handle to move in a reciprocal or return direction towards a forward end of the machine, this causes rotation of the force reduction transmission assembly in second rotation direction opposite to the first rotation direction simultaneously causing the first end of the first flexible member to move downward, thereby lowering the rearward end of the user support frame assembly such that the rearward end of the user support frame assembly decreases in elevation relative to the elevation of the forward pivot thereby causing the user support frame to pivot downwards from the forward end of the user support frame assembly to the rearward end of the user support frame assembly.

4. The exercise machine of claim 3, wherein the reciprocal motion of the pulling handle is effectuated by a user reciprocally imparting and releasing the pulling force on the pulling handle and wherein the force reduction transmission assembly reduces the pulling force required by a user to pivot a user and the user support frame assembly relative to the base frame and to lift a user and the rearward end of the user support frame assembly upwards relative to the base frame.

5. The exercise machine of claim 1, wherein the first flexible member and the second flexible member move simultaneously during operation of the machine, and the force reduction transmission assembly controls a ratio of movement of the first flexible member relative to the second flexible member whereby the first flexible member moves a smaller distance relative to a distance moved by the second flexible member during operation of the machine.

6. The exercise machine of claim 5, wherein the user support frame assembly, the user seat, the feet support surface, the pulling handle, the first flexible member, the second flexible member, and the force reduction transmission assembly are in first position when the machine is in the first at rest and inactivated position and are in a second position when the machine is in a second engaged and fully activated position, and wherein the user support frame assembly, the user seat, the feet support surface, the pulling handle, the first flexible member, the second flexible member, and the force reduction transmission assembly are maintainable at positions anywhere in between the first at rest and inactivated position and the second engaged and fully activated position during operation of the machine.

7. The exercise machine of claim 6, wherein the user support frame assembly has a weight, and wherein, during operation of the machine, a user's weight combined with the weight of the user support frame assembly provides a resistance to the rowing exercise motion both upon the reciprocal motion of the pulling handle and when the pulling handle is stationary.

8. The exercise machine of claim 7, wherein the user support frame assembly further comprises an elongated rigid support frame, the user seat is slidably engaged with the elongated rigid support frame, the user feet support surface is rigidly mounted to the elongated rigid support frame at a location forward of the user seat, and the user support frame assembly is pivotally mounted on the base frame at a location forward of both the user feet support surface and the user seat.

9. The exercise machine of claim 8, wherein the user seat is slidably mounted on the user support frame assembly and the user feet support surface is rigidly mounted on the user support frame assembly such that a distance between the user seat and the user feet support surface is controlled by the location of the user seat and the user seat is slidable independently of all other components of the machine.

10. The exercise machine of claim 9, wherein the force reduction transmission assembly comprises at least one axle and at least two take up drums, wherein a first of the at least two take up drums has a different diameter than a second of the at least two take up drums.

11. The exercise machine of claim 10, wherein at least one of the at least two take up drums has a non-circular cam shape.

12. The exercise machine of claim 11, wherein the diameter of one of the at least two take up drums is adjustable such that the ratio of movement of the first flexible member relative to the second flexible member is adjustable and settable to various ratios prior to operation of the machine so as to either increase or decrease the amount of pulling force required by a user to lift a user and the user support frame assembly.

13. The exercise machine of claim 9, wherein the force reduction transmission assembly comprises at least two take up drums and at least two gears, wherein a first of the at least two gears has a different diameter than the others of the at least two gears.

14. The exercise machine of claim 13, wherein at least one of the at least two take up drums has a non-circular cam shape.

15. The exercise machine of claim 14, wherein the diameter of one of the at least two take up drums is adjustable such that the ratio of movement of the first flexible member relative to the second flexible member is adjustable and settable to various ratios prior to operation of the machine so as to either increase or decrease the amount of the pulling force required by a user to lift a user and the user support frame assembly.

16. A body weight resistance rowing simulator exercise machine with a force reduction transmission comprising:

a) a horizontal stationary base frame having a forward end and a rearward end;

b) a movable user support frame assembly having a forward end and a rearward end;

c) a rotatable force reduction transmission assembly mounted on the base frame, the force reduction transmission assembly comprising i) a first axle, ii) a second axle mounted parallel to the first axle, iii) a first take up drum rotatable about the first axle and having a diameter, iv) a second take up drum rotatable about the first axle and having a diameter smaller than the diameter of the first take up drum, v) a third take up drum rotatable about the second axle and mounted in alignment with the second take up drum, and vi) a fourth take up drum rotatable about the second axle, the fourth take up drum having a cam shape;

d) a first flexible member having a first end and a second end;

e) a forward pivot, wherein a forward portion of the user support frame assembly is pivotally connected to and supported on the base frame by the forward pivot at a position proximal to the forward end of the user support frame assembly and the forward end of the base frame;

f) a guide pulley assembly, wherein another portion of the user support frame assembly that is not supported on the base frame by the forward pivot is supported on the base frame by the first flexible member and the guide pulley assembly, whereby the user support frame assembly is in a substantially horizontal position when the machine is in an at rest and inactivated position;

g) a user seat slidably mounted on the user support frame;

h) a user feet support surface rigidly mounted on the forward portion of the user support frame assembly;

i) a second flexible member having a first end and a second end, wherein the first end of the second flexible member is connected to a pulling handle and the second end of the second flexible member is connected to the first take up drum; and j) a third flexible member that rotationally cooperates with the second take up drum and the third take up drum, wherein the first take up drum and the second take up drum are rotatable in unison about the first axle during operation of the machine, wherein the third take up drum and the fourth take up drum are rotatable in unison about the second axle during operation of the machine, and wherein the first end of the first flexible member is attached to a central or rearward portion of the user support frame assembly and the second end of the first flexible member is attached to the fourth take up drum, whereby during operation of the machine the user support frame assembly, the first take up drum, the second take up drum, the third take up drum, the fourth take up drum, the first flexible member, the second flexible member, the third flexible member, and the pulling handle all move simultaneously to simulate a rowing exercise motion in which the force reduction transmission assembly reduces a pulling force required by a user to pivot a user and the user support frame assembly relative to the base frame and to lift a user and the rearward end of the user support frame assembly upwards relative to the base frame.

17. The exercise machine of claim 16, wherein the first flexible member, the second flexible member, and the third flexible member move simultaneously and at different ratios relative to each other during operation of the machine, and the force reduction transmission assembly controls the ratio of movement of each of the flexible members relative to the others of the flexible members during operation of the machine.

18. The exercise machine of claim 17, wherein the user support frame assembly, the user seat, the feet support surface, the pulling handle, the first flexible member, the second flexible member, the third flexible member, and the force reduction transmission assembly are in a first position when the machine is in the first at rest and inactivated position and are in a second position when the machine is in a second engaged and fully activated position, and wherein the user support frame assembly, the user seat, the feet support surface, the pulling handle, the first flexible member, the second flexible member, the third flexible member, and the force reduction transmission assembly are maintainable anywhere in between the first at rest and inactivated position and the second engaged and fully activated position during operation of the machine.

19. The exercise machine of claim 18, wherein the user support frame assembly has a weight, and wherein, during operation of the machine, a user's weight combined with the weight of the user support frame assembly provides a resistance to the rowing exercise motion both when the pulling handle is being moved and when the pulling handle is stationary.

20. The exercise machine of claim 19, wherein the user support frame assembly further comprises an elongated rigid support frame, the user seat is slidably engaged with the elongated rigid support frame, the user feet support surface is rigidly mounted to the elongated rigid support frame at a location forward of the user seat, and the user support frame assembly is pivotally mounted on the base frame at a location forward of both the user feet support surface and the user seat.

21. The exercise machine of claim 20, wherein the user seat is slidably mounted on the user support frame assembly and the user feet support surface is rigidly mounted on the user support frame assembly such that a distance between the user seat and the user feet support surface is controlled by the location of the user seat and the user seat is slidable independently of all other components of the machine.

22. The exercise machine of claim 21, wherein the diameter of one of the take up drums is adjustable such that the ratio of the speed of rotation of the first and second take up drums relative to the speed of rotation of the third and fourth take up drums is adjustable and settable to various ratios prior to operation of the machine so as to either increase or decrease the amount of the pulling force required by a user to lift a user and the user support frame assembly.

23. The exercise machine of claim 16, wherein the third flexible member has a first end and a second end, wherein the first end of the third flexible member is connected to the second take up drum and the second end of the third flexible member is connected to the third take up drum.

24. The exercise machine of claim 16, wherein the third flexible member is an endless belt.

25. A body weight resistance rowing simulator exercise machine with a force reduction lever support bar assembly comprising:

a) a horizontal stationary base frame having a forward end and a rearward end;

b) a movable user support frame assembly having a forward end and a rearward end;

c) a forward pivot, wherein a forward portion of the user support frame assembly is pivotally connected to and supported on the base frame by the forward pivot at a position proximal to the forward end of the user support frame assembly and the forward end of the base frame;

d) a lever bar support assembly comprising a first pivoting lever bar having a first end and second end and a second pivoting lever bar having a first end and second end, i) wherein another portion of the user support frame assembly that is not supported on the base frame by the forward pivot is supported on the base frame by the first pivoting lever bar and the second pivoting lever bar, ii) wherein the first end of the first pivoting lever bar is pivotally connected to the base frame, iii) wherein the second end of the first pivoting lever bar is pivotally connected to the first end of the second pivoting lever bar, iv) wherein the second end of the second pivoting lever bar is pivotally connected to a central or rearward portion of the user support frame assembly, and v) the user support frame assembly is in a substantially horizontal position when the machine in in an at rest and inactivated position;

e) a user seat slidably mounted on the user support frame;

f) a user feet support surface rigidly mounted on the forward portion of the user support frame assembly; and g) a flexible member having a first end and a second end, wherein the first end of the flexible member is connected to the first pivoting lever bar and the second end of the flexible member is a connected to a pulling handle, whereby a reciprocal motion of the pulling handle by a user while a user slides the user seat forwards and backwards on the user support frame assembly simulates a rowing exercise motion.

26. The exercise machine of claim 25, wherein when a user imparts a pulling force on the pulling handle in a pulling direction towards a rearward end of the machine, this causes the first end of the flexible member to move upward, thereby lifting the second end of the first pivoting lever bar, causing the first and second ends of the first and second pivoting lever bars to pivot upwards, thereby lifting the rearward end of the user support frame assembly, causing the user support frame assembly to pivot about an axle mounted on a forward portion of the base frame, whereby the rearward end of the user support frame assembly increases in elevation relative to the elevation of the forward pivot.

27. The exercise machine of claim 26, wherein when a user reduces the pulling force on the pulling handle allowing the pulling handle to move in a reciprocal or return direction towards a front end of the machine, this causes the first end of the flexible member to lower the second end of the first pivoting lever bar, causing the first and second ends of the first and second pivoting lever bars to pivot and lower the rearward end of the user support frame assembly, causing the user support frame assembly to pivot about the axle mounted on the forward portion of the base frame, whereby the rearward end of the user support frame assembly decreases in elevation relative to the elevation of the forward pivot.

28. The exercise machine of claim 27, wherein the reciprocal motion of the pulling handle effectuated by a user by reciprocally imparting and releasing the pulling force on the pulling handle while simultaneously sliding the user seat forwards and backwards on the user support frame assembly simulates a rowing exercise motion in which the lever bar support assembly reduces the pulling force required by a user to pivot a user and the user support frame assembly relative to the base frame and lift a user and the user support frame assembly upward relative to the base frame.

29. The exercise machine of claim 25, wherein the user support frame assembly, the user seat, the feet support surface, the pulling handle, the flexible member, the first pivoting lever bar, and the second pivoting lever bar are in a first position when the machine is in the first at rest and inactivated position and are in a second position when the machine is in a second engaged and fully activated position, and wherein the user support frame assembly, the user seat, the feet support surface, the pulling handle, the flexible member, the first pivoting lever bar, and the second pivoting lever bar are maintainable anywhere in between the first at rest and inactivated position and the second engaged and fully activated position during operation of the machine.

30. The exercise machine of claim 29, wherein the user support frame assembly has a weight, wherein the first pivotable lever bar has a weight, the second pivotable lever bar has a weight, and wherein, during operation of the machine, a user's weight combined with the weight of the user support frame assembly, the weight of the first pivotable lever bar, and the second pivotable lever bar provides a resistance to the rowing exercise motion both when the pulling handle is being moved and when the pulling handle is stationary.

31. The exercise machine of claim 30, wherein the user support frame assembly further comprises an elongated rigid support frame, the user seat is slidably engaged with the elongated rigid support frame, and the user feet support surface is rigidly mounted to the elongated rigid support frame, and wherein the user support frame assembly is pivotally mounted on the base frame at a location forward of both the user feet support surface and the user seat.

32. The exercise machine of claim 31, wherein the user seat is slidably mounted on the user support frame assembly and the user feet support surface is rigidly mounted on the user support frame assembly such that a distance between the user seat and the user feet support surface is controlled by the location of the user seat and the user seat is slidable independently of all other components on the machine.

33. The exercise machine of claim 32, wherein the location of the connection of the flexible member to the first pivoting lever bar is adjustable such that a ratio of movement of the flexible member relative to movement of the first and second pivoting lever bars is adjustable and settable to various ratios prior to operation of the machine so as to either increase or decrease the amount of the pulling force required by a user to lift a user and the user support frame assembly.

34. The exercise machine of claim 25, further comprising a force reduction transmission assembly that transfers the pulling force imparted upon the pulling handle to the lever support bar assembly.

* * * * *